US010345726B2

(12) United States Patent
Nakamura et al.

(10) Patent No.: US 10,345,726 B2
(45) Date of Patent: Jul. 9, 2019

(54) METHOD OF MANUFACTURING TONER

(71) Applicant: CANON KABUSHIKI KAISHA, Tokyo (JP)

(72) Inventors: Kunihiko Nakamura, Gotemba (JP); Kenta Kamikura, Yokohama (JP); Maho Tanaka, Tokyo (JP); Fumiya Hatakeyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/974,917

(22) Filed: May 9, 2018

(65) Prior Publication Data

US 2018/0329321 A1 Nov. 15, 2018

(30) Foreign Application Priority Data

May 15, 2017 (JP) ..... 2017-096355

(51) Int. Cl.
*G03G 9/00* (2006.01)
*G03G 9/08* (2006.01)
(Continued)

(52) U.S. Cl.
CPC ..... *G03G 9/0806* (2013.01); *G03G 9/0812* (2013.01); *G03G 9/0823* (2013.01);
(Continued)

(58) Field of Classification Search
CPC .. G03G 9/0804; G03G 9/093; G03G 9/09392; G03G 9/09328; G03G 9/09342
See application file for complete search history.

(56) References Cited

U.S. PATENT DOCUMENTS 7,858,283 B2 12/2010 Ishigami et al.
7,927,775 B2 4/2011 Komatsu et al.
(Continued)

FOREIGN PATENT DOCUMENTS

JP H05-027473 2/1993
JP H08-292599 11/1996
(Continued)

OTHER PUBLICATIONS

U.S. Appl. No. 15/969,318, Tsuneyoshi Tominaga, filed May 2, 2018.
(Continued)

*Primary Examiner* — Mark A Chapman
(74) *Attorney, Agent, or Firm* — Venable LLP

(57) ABSTRACT

There is provided a method of manufacturing a toner including a toner particle containing a binder resin, the method including:

process 1: preparing a mixed solution including the following components i) to iii) in an aqueous medium:

i) a particular silicon compound, ii) a fine particle having a number average particle diameter of 3 nm or more and 500 nm or less, and iii) a toner base particle containing the binder resin; and process 2: adjusting a pH of the mixed solution to 7.0 or more and 12.0 or less to condense the silicon compound, wherein the fine particle has an absolute value of zeta potential of 10.0 mV or more at the pH of the mixed solution of process 1.

5 Claims, 3 Drawing Sheets

(51) Int. Cl.
*G03G 9/093* (2006.01)
*G03G 9/087* (2006.01)

(52) U.S. Cl.
CPC ..... *G03G 9/0825* (2013.01); *G03G 9/08708* (2013.01); *G03G 9/08711* (2013.01); *G03G 9/08773* (2013.01); *G03G 9/09328* (2013.01); *G03G 9/09392* (2013.01)

(56) References Cited

U.S. PATENT DOCUMENTS

| | | | |
|---|---|---|---|
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,828,639 | B2 | 9/2014 | Kamikura et al. |
| 8,986,914 | B2 | 3/2015 | Fujikawa et al. |
| 9,034,549 | B2 | 5/2015 | Shiotari et al. |
| 9,261,806 | B2 | 2/2016 | Moribe et al. |
| 9,285,697 | B2 | 3/2016 | Fukudome et al. |
| 9,298,116 | B2 | 3/2016 | Maetani et al. |
| 9,423,708 | B2 | 8/2016 | Tominaga et al. |
| 9,594,323 | B2 | 3/2017 | Fujikawa et al. |
| 9,829,820 | B2 | 11/2017 | Masumoto et al. |
| 9,880,478 | B2 | 1/2018 | Shimano et al. |
| 9,897,933 | B2 | 2/2018 | Yoshida et al. |
| 9,921,501 | B2 | 3/2018 | Mochizuki et al. |
| 9,952,523 | B2 | 4/2018 | Shimano et al. |
| 2004/0034203 | A1* | 2/2004 | Brook ..... B01J 20/103 530/402 |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |

FOREIGN PATENT DOCUMENTS

| | | |
|---|---|---|
| JP | 4119424 | 7/2008 |
| JP | 2012-194314 | 10/2012 |
| JP | 2015-106023 | 6/2015 |

OTHER PUBLICATIONS

U.S. Appl. No. 15/973,661, Kenta Kamikura, filed May 8, 2018.
U.S. Appl. No. 15/974,187, Sara Yoshida, filed May 8, 2018.
U.S. Appl. No. 15/974,928, Fumiya Hatakeyama, filed May 9, 2018.
U.S. Appl. No. 15/974,936, Kenta Kamikura, filed May 9, 2018.
U.S. Appl. No. 15/974,969, Maho Tanaka, filed May 9, 2018.
U.S. Appl. No. 15/975,064, Kunihiko Nakamura, filed May 9, 2018.
U.S. Appl. No. 15/975,305, Kentaro Yamawaki, filed May 9, 2018.
Kitahara et al, "Zeta Potential", Scientist Press Co., Ltd.

* cited by examiner

METHOD OF MANUFACTURING TONER

BACKGROUND OF THE INVENTION

Field of the Invention

The present disclosure relates to a method of manufacturing a toner used in an image forming method such as electrophotography and electrostatic printing.

Description of the Related Art

Recently, with the development of computers and multimedia, units for outputting high-definition full-color images are required, in a wide variety of fields from office to home, and further improvement of toner performance is required. In particular, it has been much reviewed to attach fine particles on the surface of a toner or embedding fine particles therein, for improving developability, transferability, and thermal resistance.

Japanese Patent Application Laid-Open No. 2012-194314 discloses a toner having a convex portion formed by embedding resin fine particles in the surface of toner particles, for improving thermal resistance.

Japanese Patent Application Laid-Open No. 2015-106023 discloses a toner formed by attaching organic fine particles on the surface of toner base particles (toner core), and further coating the surface of the toner core having the organic fine particles attached thereon with a melamine-based resin or a urea-based resin.

Further, Japanese Patent Application Laid-Open No. H08-292599 discloses a toner having reduced adhesiveness by coating an outermost layer having inorganic fine particles with a coating of a silane coupling agent.

Since the toner of Japanese Patent Application Laid-Open No. 2012-194314 has a convex portion of resin fine particles on the surface of toner particles, thermal resistance thereof is good, but transferability may be sometimes deteriorated. It is considered that since the convex portion is formed of resin fine particles, the adhesiveness of the toner is not decreased. In addition, it is also considered that though the toner is mixed with silica and the like with the expectation of decreasing the adhesiveness of the toner, it is difficult to attach silica on the convex portion by the resin fine particles, and thus, the adhesiveness of the toner is not sufficiently decreased.

The toner of Japanese Patent Application Laid-Open No. 2015-106023 has improved adhesion to a developing sleeve, as compared with the toner with no organic fine particles attached, however, it was confirmed that an image concentration is reduced after printing a large number of sheets. It is considered that since titanium oxide particles or silica particles added thereto are embedded in the toner particles having an organic shell layer such as a melamine-based resin or a urea-based resin when printing a large number of sheets, a flowability improvement effect is reduced.

The toner of Japanese Patent Application Laid-Open No. H08-292599 has improved initial transfer efficiency, but when using the toner for a prolonged time, the inorganic fine particles on the surface of the toner are released, thereby deteriorating transferability.

The present disclosure has been made in view of the above problems, and it is an object of the present disclosure to provide a method of manufacturing a toner in which fine particles are fixed to the surface of toner base particles, so that the fine particles are less likely to be released from the surface of the toner base particles even after printing a large number of sheets.

SUMMARY OF THE INVENTION

As a result of intensive studies thereon, the present inventors have found that the above object may be achieved by the following configuration.

That is, according to the present disclosure, there is provided a method of manufacturing a toner including a toner particle containing a binder resin, the method including:

process 1: preparing a mixed solution including the following components i) to iii) in an aqueous medium:

i) a silicon compound represented by the following Formula (1), ii) a fine particle having a number average particle diameter of 3 nm or more and 500 nm or less, and iii) a toner base particle containing the binder resin; and process 2: adjusting a pH of the mixed solution to 7.0 or more and 12.0 or less to condense the silicon compound, wherein the fine particle has an absolute value of zeta potential of 10.0 mV or more at the pH of the mixed solution of process 1:

$$(R^a)_n—Si—(R^b)_{4-n} \quad (1)$$

where $R^a$ independently represents a halogen atom, a hydroxyl group, or an alkoxy group; $R^b$ independently represents an alkyl group, an alkenyl group, an acyl group, an aryl group, acryloxyalkyl group or a methacryloxyalkyl group; and n is an integer of 1 to 4.

Further, the present disclosure provides a method of manufacturing a toner including a toner particle containing a binder resin, including:

process 3: preparing a mixed solution including the following components i) to iii) in an aqueous medium:

i) a silicon compound represented by the above Formula (1), ii) an aqueous dispersion of a fine particle having a number average particle diameter of 3 nm or more and 500 nm or less, and iii) a toner base particle, or a toner particle precursor containing the binder resin; and process 4: adjusting a pH of the mixed solution to 7.0 or more and 12.0 or less to condense the silicon compound, wherein the fine particle has an absolute value of zeta potential of 10.0 mV or more at the pH of the mixed solution of process 3.

Further features of the present disclosure will become apparent from the following description of exemplary embodiments with reference to the attached drawings.

DESCRIPTION OF THE EMBODIMENTS

Figure 1:
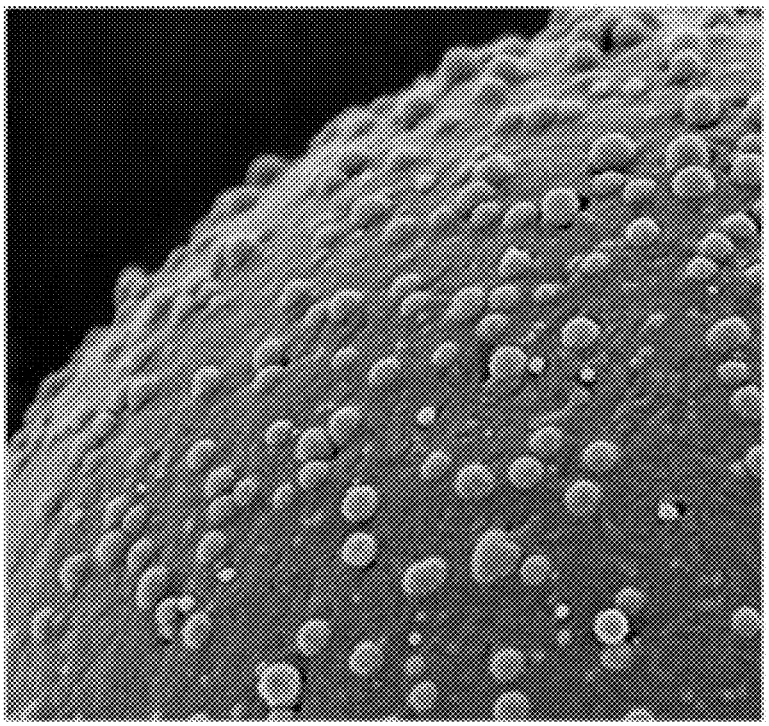
FIG. 1 is a microphotograph of a surface of a toner particle manufactured by a method of manufacturing a toner according to the present disclosure (a photograph substituted for a drawing).

The present disclosure is directed to a method of manufacturing a toner including a toner particle containing a binder resin, including:

process 1: preparing a mixed solution including the following components i) to iii) in an aqueous medium:

i) a silicon compound represented by the following Formula (1), ii) a fine particle having a number average particle diameter of 3 nm or more and 500 nm or less, and iii) a toner base particle containing the binder resin; and process 2: adjusting a pH of the mixed solution to 7.0 or more and 12.0 or less to condense the silicon compound, wherein the fine particle has an absolute value of zeta potential of 10.0 mV or more at the pH of the mixed solution of process 1, $$(R^a)_n—Si—(R^b)_{4-n} \quad (1)$$

wherein $R^a$ independently represents a halogen atom, a hydroxyl group, or an alkoxy group; $R^b$ independently represents an alkyl group, an alkenyl group, an acyl group, an aryl group, acryloxyalkyl group or a methacryloxyalkyl group; and n is an integer of 1 to 4.

Further, the present disclosure is directed to a method of manufacturing a toner including a toner particle containing a binder resin, including:

process 3: preparing a mixed solution including the following components i) to iii) in an aqueous medium:

i) a silicon compound represented by the above Formula (1), ii) an aqueous dispersion of a fine particle having a number average particle diameter of 3 nm or more and 500 nm or less, and iii) a toner base particle, or a toner particle precursor containing the binder resin; and process 4: adjusting a pH of the mixed solution to 7.0 or more and 12.0 or less, and condensing the silicon compound, wherein the fine particle has an absolute value of zeta potential of 10.0 mV or more at the pH of the mixed solution of process 3.

Hereinafter, the summary of the present disclosure is described. First, processes 1 and 2 are described.

process 1: preparing a mixed solution including the following components i) to iii) in an aqueous medium:

i) a silicon compound represented by the above Formula (1), ii) a fine particle having a number average particle diameter of 3 nm or more and 500 nm or less, and iii) a toner base particle including a binder resin, The silicon compound of i) is a material having two functions of coating the surface of the fine particles, and embedding the fine particles in the toner base particle.

Herein, as the embodiment in which the fine particle exists in a state of being embedded in the toner base particle, the following are represented.

Specifically, the embodiment means the state that when a distance between a highest point of a portion of the fine particle protruding from the toner base particle (a convex portion) and a lowest point of a deepest portion of the embedded fine particle in the toner base particle is a fine particle diameter (R), and a distance between a lowest point of a deepest portion of the embedded fine particle of the toner base particle and the surface of the toner base particle is a fine particle embedding length (r), an embedding rate of the fine particle to the toner base particle, represented by r/R×100 is 20% or more. When the embedding rate of the fine particle to the toner base particle is less than 20%, it is the state that the fine particle is attached to the toner base particle. In addition, whether the fine particle is firmly attached to the toner base particle is determined by "a fine particle releasing rate" described later, and when the fine particle releasing rate is less than 20%, the fine particle is determined to be firmly attached.

Even though the fine particle may be embedded in the surface of the toner base particle by the conventionally carried out method of embedding the fine particle by mechanical impact force, it is difficult to firmly attach the fine particle to the toner base particle.

The fine particle in ii) having a number average particle diameter of 3 nm or more and 500 nm or less is a material for forming a convex portion on the surface of the toner particle.

The toner base particle in iii) is any material as long as it contains the binder resin. The specific examples of the materials of i), ii), and iii) are described below.

The preparation of the mixed solution of the materials may be carried out using any mixing unit.

In process 1, adjusting the pH of the mixed solution may be carried out after obtaining the mixed solution. In addition, dispersing the fine particles in the mixed solution may be carried out. The process is preferred, since by uniformly dispersing the fine particles, the fine particle may be fixed to the surface of the toner base particle in a state of being more uniformly dispersed. In dispersing the fine particles, for example, a high-pressure type homogenizer, a rotary shearing type homogenizer, an ultrasonic dispersing machine, a high-pressure impact type dispersing machine, or the like may be used.

In addition, the fine particle is required to have an absolute value of zeta potential of 10.0 mV or more at the pH of the mixed solution of process 1. According to the DLVO theory (see "Zeta Potential" by Ayao Kitahara et al., Scientist Press Co., Ltd.), it is known that dispersion of the fine particles is stabilized in an aqueous medium by electrical repulsion. In order to stabilize the dispersion state of the fine particles by the electrical repulsion, the fine particle is required to have an absolute value of the zeta potential of 10.0 mV or more.

In addition, the zeta potential of the fine particle varies with the pH of the aqueous medium. Therefore, the dispersibility of the fine particles is sufficiently stabilized, by having the absolute value of the zeta potential of 10.0 mV or more at the pH of the mixed solution of process 1. "The pH of the mixed solution of process 1" refers to preferably the pH adjusted after preparing the mixed solution, and more preferably the pH in a process as described below of maintaining the pH of the mixed solution to pH (A). The absolute value of the zeta potential is preferably 15 mV or more. The upper limit is not particularly limited, but it is preferably 100 mV or less, and more preferably 80 mV or less. The zeta potential may be controlled by the type or amount of surface functional group of the fine particle.

Process 2: adjusting a pH of the obtained mixed solution to 7.0 or more and 12.0 or less to condense the silicon compound.

In process 2, the following two may be achieved simultaneously, by condensing the silicon compound:

allowing the silicon compound condensate coating the surface of the fine particle to have a high molecular weight, thereby fixing the fine particles to the surface of the toner base particle; and reducing the amount of a silanol group remaining in the mixed solution (hereinafter, referred to as "the amount of a residual silanol group"), thereby achieving a high charge quantity.

The inventors consider these mechanisms as follows.

$R^a$ of the silicon compound is hydrolyzed in an aqueous medium to be a silanol group, and then the silanol groups are condensed with each other.

Figure 2:
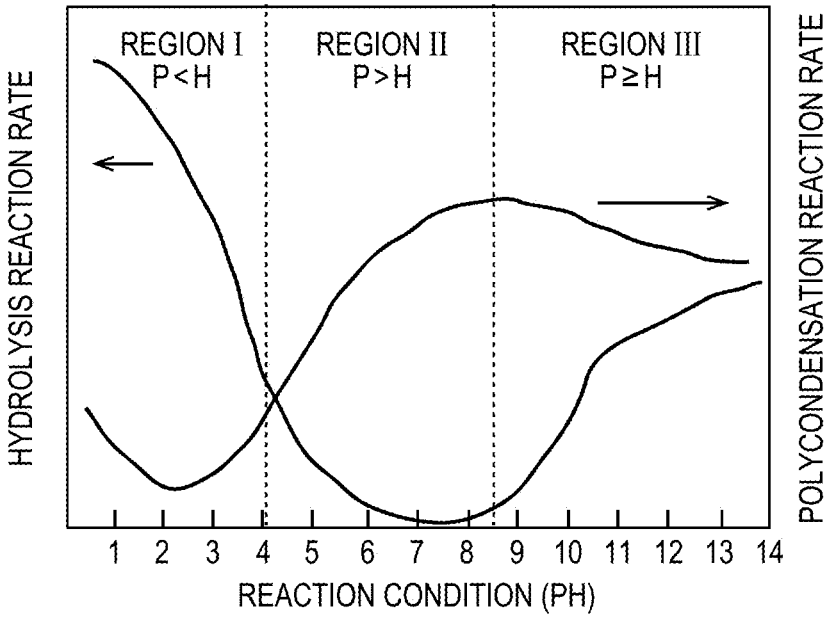
FIG. 2 is a schematic diagram showing pH dependency of a hydrolysis reaction rate and a polycondensation reaction rate in a sol-gel reaction.

As shown in FIG. 2, it is known that the hydrolysis and the condensation reaction of the silicon compound (silane coupling agent) have pH dependency.

The condensation reaction of the silicon compound (silane coupling agent) effectively proceeds in a range of pH 7.0 or more and 12.0 or less.

When the pH of the mixed solution is adjusted to 7.0 or more and 12.0 or less to condensate the organosilicon compound, the condensate of the organosilicon compound is attached to the surface of the fine particle, in a state of having reduced stability to the aqueous medium.

The condensate of the organosilicon compound attached to the surface of the fine particle is further condensed. As the condensation reaction proceeds, the condensate of the organosilicon compound is further hydrophobized by the effect of the Si element.

That is, the surface of the fine particle is coated with the condensate of the hydrophobized organosilicon compound.

Since the fine particle coated with the condensate of the hydrophobized organosilicon compound is difficult to be stably present in the aqueous medium, it is embedded in the toner base particle, in order to prevent the surface of the fine particle from being in the aqueous medium. In addition, at this time, since the condensate of the organosilicon compound serves as an additive of the interface between the fine particle and the toner base particle, the fine particle is firmly fixed to the toner base particle.

In addition, since the fine particle having the absolute value of the zeta potential of 10.0 mV or more has high hygroscopicity, it is difficult to use the fine particle in the toner as it is. However, by undergoing the above process using the organosilicon compound, the surface of the fine particle is coated with the condensate of the hydrophobized silicon compound, thereby being preferably used in the toner.

By using the manufacturing method, surface treatment of the fine particle in which the fine particle is coated with the condensate of the silicon compound as an inorganic material, and treatment of fixing the fine particles to the toner base particle may be performed simultaneously.

By the following methods (A) and (B) which have been conventionally performed, the condensate of the organosilicon compound is not able to invade the interface between the toner base particle and the fine particle, and thus, it was difficult to raise a fixation rate of the fine particle to the toner base particle:

(A) a method of embedding the hydrophobized fine particles (e.g., hexamethyldisilazane-treated silica fine particles) in the surface of the toner base particle by mechanical impact force.

(B) a method of embedding the hydrophobized fine particles by mechanical impact force, and then coating the surface of the toner base particle with the condensate of the organosilicon compound.

Next, processes 3 and 4 are described.

Process 3: preparing a mixed solution including the following components i) to iii) in an aqueous medium:

i) a silicon compound represented by the following Formula (1), ii) an aqueous dispersion of a fine particle having a number average particle diameter of 3 nm or more and 500 nm or less, and iii) a toner base particle, or a toner base particle precursor containing the binder resin.

Process 3 is identical to process 1, except for using the aqueous dispersion of the fine particles as ii).

The aqueous dispersion of the fine particles may be used by obtaining the aqueous dispersion of the fine particles which has been already dispersed. In addition, the dispersion may be obtained by dispersing the fine particles in water. By uniformly dispersing the fine particles, the fine particle may be fixed to the surface of the toner base particle in a state of being uniformly dispersed.

The dispersion of the fine particles may be performed using, for example, a high-pressure type homogenizer, a rotary shearing type homogenizer, an ultrasonic dispersing machine, a high-pressure impact type dispersing machine, or the like.

It is required that the absolute value of the zeta potential of the fine particle at the pH of the mixed solution of process 3 is 10.0 mV or more, for dispersion stability of the fine particles, as in process 1.

The toner base particle precursor may, for example, include a polymerizable monomer capable of forming the binder resin. The polymerization of the polymerizable monomer in the toner base particle precursor may be performed after preparing the mixed solution, and preferably adjusting the pH to pH (A) described below in process 3, or simultaneously with condensation of the organosilicon compound in process 4.

Process 4: adjusting a pH of the obtained mixed solution to 7.0 or more and 12.0 or less, and condensing the silicon compound.

Process 4 is identical to process 2 as described above.

As described above, by using the method of manufacturing a toner including processes 1 and 2, or processes 3 and 4, a toner having the fine particles fixed to the surface, in which the surface of the fine particle is coated with the condensate of the silicon compound may be manufactured.

Next, the materials which may be used in the toner are described.

(1) Silicon Compound Represented by the Following Formula (1):

$$(R^a)_n—Si—(R^b)_{4-n} \quad (1)$$

wherein $R^a$ independently represents a halogen atom, a hydroxyl group, or an alkoxy group; $R^b$ independently represents an alkyl group, an alkenyl group, an acyl group, an aryl group, acryloxyalkyl group or a methacryloxyalkyl group; and n is an integer of 1 to 4.

In the above Formula (1), the alkyl group has preferably 1 to 12 carbon atoms, and more preferably 1 to 6 carbon atoms.

The alkenyl group has preferably 2 to 6 carbon atoms, and more preferably 2 to 4 carbon atoms.

The acyl group has preferably 2 to 6 carbon atoms, and more preferably 2 to 4 carbon atoms.

The aryl group has preferably 6 to 14 carbon atoms. The aryl group may be preferably a phenyl group.

The alkyl group in the acryloxyalkyl group or methacryloxyalkyl group has preferably 1 to 6 carbon atoms, and more preferably 1 to 4 carbon atoms.

The alkoxy group has preferably 1 to 10 carbon atoms, and more preferably 1 to 6 carbon atoms.

The silicon compound represented by Formula (1) has two functions of coating the surface of the fine particle, and fixing the fine particle to the toner base particle.

It is required for the toner to have a surface which is difficult to deteriorate, and to suppress the release of the fine particles, for achieving printing quality which is not changed even when printing a large number of sheets. In order to achieve the release suppression of these fine particles, it is preferred that the surface of the fine particle present in the toner is hard. It is difficult to achieve this hardness in an organic resin. Therefore, it was found that the silicon compound represented by the above Formula (1) which is an inorganic compound and produces a condensate having a siloxane bond (—Si—O—Si—) as a main skeleton is suitable for achieving this hardness.

The example of the silicon compound represented by Formula (1) may include various silane compounds such as monofunctional, difunctional, trifunctional, and tetrafunctional silane compounds, as described below:

Monofunctional silane compound: trimethylethoxysilane, triethylmethoxysilane, triethylethoxysilane, triisobutylmethoxysilane, triisopropylmethoxysilane, tri 2-ethylhexylmethoxysilane, etc.

Difunctional silane compound: dimethylmethoxysilane, dimethyldiethoxysilane, etc.

Trifunctional methylsilane: methyltrimethoxysilane, methyltriethoxysilane, methyldiethoxymethoxysilane, and methylethoxydimethoxysilane.

Trifunctional silane compound: ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltriethoxysilane, octyltrimethoxysilane, etc.

Trifunctional phenylsilane: phenyltrimethoxysilane, phenyltriethoxysilane, etc.

Trifunctional vinylsilane: vinyltrimethoxysilane, vinyltriethoxysilane, etc.

Trifunctional allylsilane: allyltrimethoxysilane, allyltriethoxysilane, allyldiethoxymethoxysilane, allylethoxydimethoxysilane, etc.

Trifunctional γ-acryloxyalkylsilane: γ-acryloxypropyltrimethoxysilane, γ-acryloxypropyldiethoxymethoxysilane, γ-acryloxypropylethoxydimethoxysilane, γ-acryloxypropyltriethoxysilane etc.

Trifunctional γ-methacryloxypropylsilane: γ-methacryloxypropyltrimethoxysilane, γ-methacryloxypropyltriethoxysilane, γ-methacryloxypropyldiethoxymethoxysilane, γ-methacryloxypropylethoxydimethoxysilane, etc.

Tetrafunctional silane compound: tetramethoxysilane, tetraethoxysilane, tetrapropoxysilane, tetrabutoxysilane, etc.

Among them, difunctional, trifunctional, and tetrafunctional silane compounds are preferred, since they form a crosslinked structure in the polycondensation reaction to raise the strength of the toner. In particular, the trifunctional and tetrafunctional silane compounds are more preferred, since they may form a three-dimensionally crosslinked firm film.

The silicon compound may be added to the aqueous medium by an optional method. The silicon compound may be added as it is, however, it is preferred that the silicon compound and the aqueous medium are mixed, previously hydrolyzed, and then added.

The organosilicon compound to be hydrolyzed is condensed after hydrolyzing it. Since the optimal pH of the two reactions is different from each other, it is more preferred that the organosilicon compound and the aqueous medium are previously mixed, hydrolyzed at the pH where the hydrolyzation reaction is rapid, and then condensed at the optimal pH for the condensation reaction, thereby shortening the reaction time.

It is preferred that the amount of silicon compound in the mixed solution is 0.1 parts by mass or more and 20.0 parts by mass or less, based on 100 parts by mass of the toner base particles or the toner particle precursor, for easy formation of the condensate of the silicon compound, and surface coatability of the fine particles. More preferably, the amount is 0.3 parts by mass or more and 15.0 parts by mass or less.

(2) Fine Particle Having a Number Average Particle Diameter of 3 nm or More and 500 nm or Less Fine particles having a number average particle diameter of 3 nm or more and 500 nm or less are used, since they may form a convex portion, while raising fixation strength of the toner base particle and the fine particles. The fine particles have a number average particle diameter of preferably 30 nm or more and 300 nm or less, and more preferably 50 nm or more and 200 nm or less.

Within the above range of the number average particle diameter, a minute convex portion is formed on the surface of the toner particle to reduce the adhesiveness of the toner, thereby improving transferability and flowability of the toner.

The fine particle is not particularly limited, however, may be an inorganic fine particle such as a silica fine particle, a titania fine particle, an alumina fine particle, and a hydrotalcite fine particle, a polymer-based resin fine particle such as a polymethylmethacrylate resin fine particle, a urethane resin fine particle, a phenol resin fine particle, a polystyrene resin fine particle, and the like. Among them, the inorganic fine particle is preferred. Since the fine particle itself had high hardness, the shape of the inorganic fine particle is difficult to change even after printing a large number of sheets. In addition, it is preferred that since the inorganic fine particle has high reactivity with the silicon compound, it may form a firm condensate layer of the silicon compound on the surface of the toner particle, and is difficult to release from the surface of the toner base particle.

In particular, the silica fine particle is more preferred, since it firmly reacts with the condensate of the silicon compound. The example of the method of manufacturing the silica fine particle may include the following:

a burning method of burning a silane compound to obtain a silica particle (i.e., a method of manufacturing fumed silica); a deflagration method of explosively burning metal silicon powder to obtain a silica particle; a wet method of obtaining a silica particle by a neutral reaction of sodium silicate and an inorganic acid (in this method, synthesis under an alkaline condition is referred to as a precipitation method, and synthesis under an acidic condition is referred to as a gel method); and a sol-gel method of obtaining a silica particle by hydrolysis of alkoxysilane such as hydrocarbyloxysilane (so called, a Stoeber method).

It is preferred that the content of the fine particle is 0.1 parts by mass or more and 10.0 parts by mass or less, based on 100 parts by mass of the toner base particles or the toner particle precursor, since release of the fine particles from the toner base particle or the toner particle precursor may be suppressed. More preferably, the content is 0.3 parts by mass or more and 7.0 parts by mass or less.

(3) Toner Base Particle, or Toner Particle Precursor Containing Binder Resin

"The toner particle precursor" is as described above. The constituent materials of the toner base particle are described in a method of manufacturing a toner base particle described below.

(4) Process of Condensing Silicon Compound (Process 2 or 4)

As described above, the silicon compound is condensed at pH (B) of 7.0 or more and 12.0 or less of the mixed solution in the condensation process of the silicon compound (process 2 or 4).

By doing so, the surface of the fine particle is coated with the condensate of the silicon compound, while the fine particles are fixed to the surface of the toner base particle. Since the condensation rate of the silicon compound is high, pH is more preferably 8.0 or more and 12.0 or less.

Further, in order to further increase the fixation strength of the fine particle to the toner base particle, it is preferred to efficiently proceed with the contact of i) a low-condensed silicon compound, ii) the fine particle, and iii) the toner base particle (or the toner particle precursor). Therefore, after preparing the mixed solution in process 1 (or process 3), or before raising the condensation degree of the silicon compound in process 2 or 4, it is preferred that the mixed solution is stirred at pH 3.0 or more and 8.0 or less, for efficiently hydrolyzing the silicon compound to sufficiently obtain the low-condensed silicon compound. By doing so, the contact of the fine particle, the toner base particle (or the toner particle precursor), and a low-condensed silicon compound is promoted. (Process of stirring by maintaining pH (A))

After sufficiently promoting the contact of i) to iii), the pH value of the mixed solution is adjusted to 8.0 or more and 12.0 or less at which the condensation rate of the silicon compound is rapid, thereby raising the condensation degree of the silicon compound to more firmly fix the fine particles, and decrease the amount of residual silanol. Therefore, a high charge quantity may be achieved, together with firm fixation.

From the above, in process 1 (or process 3), it is preferred to maintain the pH of the mixed solution at pH (A), after preparing the mixed solution. In addition, in process 2 (or process 4), it is preferred to satisfy the following Equations (1) to (3), when the pH of the mixed solution is adjusted to pH (B). As a result, the toner in which the fine particles are firmly fixed to the surface of the toner base particle may be obtained.

$$3.0 \leq pH(A) \leq 8.0, \quad \text{Equation (1)}$$

$$8.0 \leq pH(B) \leq 12.0, \quad \text{Equation (2)}$$

$$pH(B) - pH(A) \geq 1.0. \quad \text{Equation (3)}$$

In addition, pH (A) is preferably 4.0 or more and 7.0 or less, and pH (B) is preferably 9.0 or more and 11.0 or less.

pH (B)−pH (A) is more preferably 2.0 or more. The upper limit of pH (B)−pH (A) is not particularly limited, and preferably 7.0 or less.

The pH of the aqueous medium or mixed solution may be controlled by the conventional acid or alkali. As the acid for adjusting pH, the following may be listed:

hydrochloric acid, bromic acid, iodic acid, perbromic acid, metaperiodic acid, permanganic acid, thiocyanic acid, sulfuric acid, nitric acid, phosphonic acid, phosphoric acid, diphosphoric acid, hexafluorophosphoric acid, tetrafluoroboric acid, tripolyphosphoric acid, aspartic acid, o-aminobenzoic acid, p-aminobenzoic acid, isonicotinic acid, oxaloacetic acid, citric acid, 2-glycerin phosphoric acid, glutamic acid, cyanoacetic acid, oxalic acid, trichloroacetic acid, o-nitrobenzoic acid, nitroacetic acid, picric acid, picolinic acid, pyruvic acid, fumaric acid, fluoroacetic acid, bromoacetic acid, o-bromobenzoic acid, maleic acid, and malonic acid.

As the base for adjusting pH, the following may be listed:

Alkali metal hydroxides such as potassium hydroxide, sodium hydroxide, and lithium hydroxide, and aqueous solutions thereof; alkali metal carbonates such as potassium carbonate, sodium carbonate, and lithium carbonate, and aqueous solutions thereof; alkali metal sulfate such as potassium sulfate, sodium sulfate, and lithium sulfate, and aqueous solutions thereof; alkaline metal phosphates such as potassium phosphate, sodium phosphate, and lithium phosphate, and aqueous solutions thereof; alkaline earth metal hydroxides such as calcium hydroxide and magnesium hydroxide, and aqueous solutions thereof; ammonia; basic amino acids such as histidine, arginine, and lysine, and aqueous solutions thereof, and trishydroxymethylaminomethane.

These acids and bases may be used alone, or in combination of two or more.

In addition, the temperature during process 2 or 4 is not particularly limited, but the temperature of Tg or more and 105° C. or less is preferred. Tg represents a glass transition temperature of the toner base particle. In addition, the temperature is more preferably Tg+10° C. or more and 105° C. or less, and still more preferably Tg+15° C. or more and 100° C. or less.

At the temperature of Tg or higher, fixation of the fine particles may be promoted, while the condensation rate of the silicon compound may be raised. In addition, since the reaction is performed in the aqueous medium, 105° C. or less is preferred, at which the control of the temperature is easy. More preferably, the temperature is 100° C. or less.

In addition, in process 2 or 4, it is possible to perform the reaction during any required time, for sufficiently embedding the fine particles in the toner base particle.

(5) Method of Manufacturing Toner Base Particle

As the method of manufacturing the toner base particle, a suspension polymerization method, a dissolution suspension method, an emulsion aggregation method, a pulverization method, and the like may be used. When manufacturing the toner base particle in the aqueous medium, it may be used as it is as the aqueous dispersion, or after washing, filtering, or drying, it may be redispersed in the aqueous medium. When manufacturing the toner base particle by a dry method, the particles may be dispersed in the aqueous medium by a known method. In order to disperse the toner base particles in the aqueous medium, it is preferred that the aqueous medium contains a dispersion stabilizer.

As an example, a method of obtaining the toner base particle by a suspension polymerization method is described.

First, a polymerizable monomer which may produce the binder resin, and if required, various materials are mixed, and dissolved or dispersed using a dispersing machine, thereby preparing a polymerizable monomer composition. As the various materials, it is possible to properly add a coloring agent, a release agent, a charge control agent, a crystalline resin, a plasticizer, a polymerization initiator, a chain transfer agent, or another additive. As the dispersing machine, a homogenizer, a ball mill, a colloid mill, or an ultrasonic dispersing machine may be listed.

Subsequently, the polymerizable monomer composition is added to the aqueous medium containing slightly water-soluble inorganic fine particles, and droplets of the polymerizable monomer composition are prepared using a high-speed dispersing machine such as a high-speed stirrer or an ultrasonic dispersing machine (a granulation process). Thereafter, the polymerizable monomer in the droplets is polymerized to obtain the toner base particle (a polymerization process).

The polymerization initiator may be mixed when preparing the polymerizable monomer composition, or mixed in the polymerizable monomer composition immediately before forming the droplets in the aqueous medium. In addition, during granulation of the droplets, or after completion of the granulation, that is, immediately before initiating the polymerization reaction, the polymerization initiator may be added to the polymerizable monomer or other solvent in the state of being dissolved therein as required. After obtaining resin particles by polymerizing the polymerizable monomer, desolvation treatment is performed as required, thereby obtaining a dispersion of the toner base particles. Thereafter, washing or drying may be performed as required. The thus-obtained toner base particles may be used in process 1 or 3.

Next, the constituent materials of the toner are described.

(Coloring Agent)

As the coloring agent, a black pigment, a yellow pigment, a magenta pigment, a cyan pigment, and the like, as exemplified below are used.

The example of the black pigment may include carbon black or the like.

The example of the yellow pigment may include the following: a monoazo compound; a disazo compound; a condensed azo compound; an isoindolinone compound; an isoindoline compound; a benzoimidazolone compound; an anthraquinone compound; an azo metal complex; a methine compound; or an allyl amide compound. Specifically, C.I. Pigment Yellow 74, 93, 95, 109, 111, 128, 155, 174, 180, 185, etc. may be listed.

The example of the magenta pigment may include the following: a monoazo compound; a condensed azo compound; a diketopyrrolopyrrole compound; an anthraquinone compound; a quinacridone compound; a basic dye lake compound; a naphthol compound; a benzoimidazolone compound; a thioindigo compound; a perylene compound. Specifically, the following may be listed: C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, 269, C.I. Pigment Violet 19, etc.

The example of the cyan pigment may include a copper phthalocyanin compound and a derivative thereof, an anthraquinone compound; a base dye lake compound. Specifically, C.I. Pigment Blue 1, 7, 15, 15:1, 15:2, 15:3, 15:4, 60, 62, 66 may be listed.

In addition, with the pigment, various dyes which are conventionally known in the art as the coloring agent may be used in combination. It is preferred that the content of the coloring agent is 1.0 parts by mass or more and 20.0 parts by mass or less, based on 100 parts by mass of the binder resin.

(Binder Resin)

The example of the binder resin may include a vinyl resin; a polyester resin; a polyamide resin; a furan resin; an epoxy resin; a xylene resin; a silicone resin, and the like. Among them, it is preferred to use the vinyl resin. Further, as the vinyl resin, it is possible to use the following polymerizable monomers: polymers of styrene monomers such as styrene and α-methyl styrene; unsaturated carboxylic esters such as methyl acrylate, butyl acrylate, methyl methacrylate, 2-hydroxyethyl methacrylate, t-butyl methacrylate, and 2-ethylhexyl methacrylate; unsaturated carboxylic acids such as acrylic acid and methacrylic acid; unsaturated dicarboxylic acid such as maleic acid; unsaturated dicarboxylic anhydrides such as malic anhydride; nitrile-based vinyl monomers such as acrylonitrile; halogen-containing vinyl monomers such as vinyl chloride; nitro-based vinyl monomers such as nitrostyrene, or copolymers thereof. Among them, it is preferred to use a copolymer of a styrene-based monomer and an unsaturated carboxylic ester.

(Wax)

The example of the wax may include the following: esters of a monohydric alcohol and an aliphatic monocarboxylic acid, or esters of a monovalent carboxylic acids and an aliphatic monoalcohols, such as behenyl behenate, stearyl stearate, and palmityl palmitate; esters of a dihydric alcohol and an aliphatic monocarboxylic acid, or esters of a divalent carboxylic acid and an aliphatic monoalcohol, such as dibehenyl sebacate and hexanediol dibehenate; esters of a trihydric alcohol and an aliphatic monocarboxylic acid, or esters of a trivalent carboxylic acid and an aliphatic monoalcohol, such as glycerin tribehenate; esters of a tetrahydric alcohol and an aliphatic monocarboxylic acid, or esters of a tetravalent carboxylic acid and an aliphatic monoalcohol, such as pentaerythritol tetrastearate and pentaerythritol tetrapalmitate; esters of a hexahydric alcohol and an aliphatic monocarboxylic acid, or esters of a hexavalent carboxylic acid and an aliphatic monoalcohol, such as dipentaerythritol hexastearate and dipentaerythritol hexapalmitate; esters of a polyhydric alcohol and an aliphatic monocarboxylic acids, or esters of a polyvalent carboxylic acid and an aliphatic monoalcohol, such as polyglycerin behenate; natural ester waxes such as carnauba wax and rice wax; petroleum waxes such as paraffin wax, microcrystalline wax, and petrolatum, and derivatives thereof; hydrocarbon waxes by a Fischer-Tropsch process, and derivatives thereof, polyolefin waxes such as polyethylene wax and polypropylene wax, and derivatives thereof; higher aliphatic alcohols; aliphatic acids such as a stearic acid and a palmitic acid; acid amide waxes. It is preferred that the content of the wax is 0.5 parts by mass or more and 20.0 parts by mass or less, based on 100 parts by mass of the binder resin.

The toner manufactured by the above method may be used as it is, or if necessary, various organic or inorganic fine particles may be externally further added to the toner. The example of the organic or inorganic fine particle may include the following:

(1) Flowability imparting agents: silica, alumina, titanium oxide, carbon black, and carbon fluoride, (2) Abrasives: metal oxides (e.g., strontium titanate, cerium oxide, alumina, magnesium oxide, chromium oxide), nitrides (e.g., silicon nitride), carbides (e.g., silicon carbide), and metal salts (e.g., calcium sulfate, barium sulfate, calcium carbonate), (3) Lubricants: fluorinated resin powder (e.g., vinylidene fluoride, polytetrafluoroethylene) and fatty acid metal salts (e.g., zinc stearate, calcium stearate), and (4) Charge control particles: metal oxides (e.g., tin oxide, titanium oxide, zinc oxide, silica, alumina) and carbon black.

The organic or inorganic fine particles may be used by hydrophobizing the surface. As the hydrophobizing agent of the organic or inorganic fine particles, an unmodified or modified silicone varnish, an unmodified or modified silicone oil, a silane compound, a silane coupling agent, other organosilicon compounds, and organotitanium compounds may be listed. These agents may be used alone or in combination.

Hereinafter, methods of measuring each value of the physical properties defined in the present disclosure are described.

<Weight Average Particle Diameter of Toner Base Particle>

The weight average particle diameter (D4) of the toner base particle is calculated as follows: As a measuring apparatus, a precision particle size distribution measuring apparatus equipped with a 100 μm aperture tube by a micropore electrical resistance method, "Coulter Counter Multisizer 3" (registered trademark, manufactured by Beckman Coulter, Inc.) is used. For setting measurement conditions and analyzing measurement data, supplied special software, "Beckman Coulter Multisizer 3 Version 3.51" (manufactured by Beckman Coulter, Inc.) is used. Further, measurement is performed with the number of effective measurement channels of 25,000 channels.

As the electrolytic aqueous solution used for the measurement, a solution having a concentration of 1% obtained by dissolving special grade sodium chloride in ion-exchange water, for example, "ISOTON II" (product name, manufactured by Beckman Coulter, Inc.) may be used.

Further, before measurement and analysis, the special software is set as follows.

On the screen of "Change standard measurement method (SOMME)" of the special software, the total count number of the control mode is set to 50,000 particles, the number of measurements is once, and the Kd value is set to the value obtained by using "standard particle 10.0 μm" (manufactured by Backman Coulter, Inc.). By pressing the "measurement button of threshold value/noise level", the threshold and the noise level are automatically set. In addition, the current is set to 1,600 μA, the gain is set to 2, and the electrolytic solution is ISOTON II, and "flush aperture tube after measurement" is checked.

On the screen of "conversion setting from pulse to particle diameter" of the special software, the bin interval is set to a logarithmic particle diameter, the particle diameter bin is set to 256 particle diameter bin, and the particle diameter range is set to 2 μm to 60 μm.

The specific measurement method is as follows:

(1) To a 250 mL round bottom glass beaker for only Multisizer 3, 200 mL of an aqueous electrolytic solution is added, set in a sample stand, and stirred with a stirring rod at 24 revolutions/sec in a counterclockwise direction. Further, pollutants and air bubbles in the aperture tube are removed by a "flush of aperture" function of the special software.

(2) To a 100 mL flat bottom glass beaker, 30 mL of the aqueous electrolytic solution is added. A diluted solution (0.3 mL) of "Contaminon N" (a 10% aqueous solution of a neutral detergent for washing precision measuring instruments at pH 7 including a nonionic surfactant, an anionic surfactant, and an organic builder, manufactured by Wako Pure Chemical Industries, Ltd.) diluted three mass times with ion-exchange water as a dispersing agent is added thereto.

(3) Two oscillators having an oscillation frequency of 50 kHz are incorporated, with the phase shifted by 180 degrees, and an ultrasonic dispersing machine having an electrical output of 120 W, "Ultrasonic Dispersion System Tetra 150" (manufactured by Nikkaki Bios Co., Ltd.) is prepared. Ion-exchange water (3.3 L) is placed in a water tank of the ultrasonic dispersing machine, and 2 mL of Contaminon N is added to the water tank.

(4) The beaker of (2) is set to a beaker fixing hole of the ultrasonic dispersing machine, and the ultrasonic dispersing machine is operated. Further, the height position of the beaker is adjusted so that the resonance state of the liquid surface of the aqueous electrolytic solution in the beaker is maximized.

(5) To the aqueous electrolytic solution in the above beaker of (4) in a state of being irradiated with ultrasonic waves, 10 mg of the toner base particles are added in small portions, and dispersed. Then, ultrasound dispersion is continued for another 60 seconds. Then, at the time of ultrasound dispersion, the temperature of the water tank is appropriately adjusted to 10° C. or more and 40° C. or less.

(6) To the round bottom beaker of (1) installed in the sample stand, the aqueous electrolytic solution of (5) having the toner base particles dispersed therein is added dropwise using a pipette, and the measurement concentration is adjusted to 5%. Then, the measurement is performed until the number of measured particles is 50,000.

(7) The measured data is analyzed with the special software attached to the apparatus, thereby calculating the weight average particle diameter (D4). Then, the "average diameter" of the "analysis/volume statistical value (arithmetic average)" screen when set as the graph/volume % in the special software is the weight average particle diameter (D4). In addition, the "average diameter" of the "analysis/number statistical value (arithmetic average)" screen when set as the graph/number % in the special software is the number average particle diameter (D1).

<Measurement of Zeta Potential and Number Average Particle Diameter of Fine Particles>

The zeta potential and the number average particle diameter of the fine particles are measured using a system which is a combination of a particle diameter analyzer, a zeta potential analyzer, and the like (product name: Zetasizer Nano-ZS, manufactured by MALVERN).

In preparation of the sample, the fine particles are diluted with water so as to be 0.5 mass %.

Next, the pH of the sample is adjusted with 0.1 mol/L of an aqueous sodium hydroxide solution or 0.1 mol/L of an aqueous hydrochloric acid solution, so that the pH is identical to the pH of the mixed solution of process 1 or 3.

Then, for toner particles 20 to 29, pH adjustment (adjustment to pH (A)) is not performed after preparing each mixed solution in process 1 or 3, however, the zeta potential of the value of pH (A) of process 1 in Table 3 is measured.

The sample having the adjusted pH is filled in a Disposable Capillary Cell (DTS1060, manufactured by MALVERN), the cell is charged in the cell holder of the apparatus, the temperature of the sample is adjusted to 25° C., and then measurement is carried out.

The measurement conditions are as follows:

F(ka) selection Model: Smoluchowski

Dispersant: Water

Temperature: 25° C.

Result Calculation: General Purpose

After measurement, on the report screen of the measurement result to be displayed, the value of "Zeta Potential" is the average value (ζt) of the zeta potential.

<Observation of Toner>

Observation of the toner is performed using an ultra-high resolution field emission type scanning electron microscope S-4800 (manufactured by Hitachi High-Technologies Corporation). The observation conditions of S-4800 are as follows:

Inject liquid nitrogen into an anti-contamination trap attached to the mirror of S-4800 until the liquid nitrogen overflows, and allowed it to stand for 30 minutes. Start up "PC-SEM" of S-4800 to perform flushing (cleaning the FE chip which is the electron source). Click on an acceleration voltage display unit of a control panel on the screen, and press the [Flushing] button to open the flushing execution dialog. Confirm that the flushing intensity is 2 and perform flushing. Confirm that the emission current by flushing is 20 to 40 μA. Insert the sample holder into a sample chamber of the S-4800 mirror. Press the [Starting Point] on the control panel to move the sample holder to the observation position.

Click on the acceleration voltage display unit to open the HV setting dialog box, and set the acceleration voltage to [2.0 kV] and the emission current to [10 μA].

Likewise, set the probe current of the electron optical system condition block to [Normal], the focus mode to [UHR], and the WD to [3.0 mm], in the [Basic] tab of the operation panel. Press the [ON] button on the acceleration voltage display unit of the control panel to apply the acceleration voltage.

Drag in the magnification display unit of the control panel to set the magnification to 5000 (5 k) times. Rotate the focus knob [COARSE] on the operation panel, and adjust the aperture alignment when the image is somewhat in the focus within the entire field of view. Click on [Align] on the control panel to display alignment dialog, and select [Beam]. Rotate the STIGMA/ALIGNMENT knob (X,Y) of the operation panel to move the displayed beam to the center of the concentric circle. Next, select [Aperture], and rotate the STIGMA/ALIGNMENT knob (X,Y) one by one, to stop the movement of the image, or minimize the movement. Close the aperture dialog to adjust the focus with autofocus. Repeat this operation twice more, to adjust the focus.

Next, for the target toner, drag in the magnification display unit of the control panel with the center point of the maximum diameter aligned with the center of the measurement screen, and set the magnification to 30000 (30 k) times. Rotate the focus knob [COARSE] on the operation panel, and adjust the aperture alignment when the image is somewhat in the focus. Click on [Align] on the control panel to display alignment dialog, and select [Beam]. Rotate the STIGMA/ALIGNMENT knob (X,Y) of the operation panel, and move the displayed beam to the center of the concentric circle. Next, select [Aperture], and rotate the STIGMA/ALIGNMENT knob (X,Y) one by one, to stop the movement of the image, or minimize the movement. Close the aperture dialog to adjust the focus with autofocus. Thereafter, set the magnification to 50000 (50 k) times, adjust the focus using the focus knob, and the STIGMA/ALIGNMENT knob as described above, and adjust the focus with autofocus again. Repeat this operation again, to adjust the focus.

Finally, adjust brightness in the ABC mode, and take photographs with a size of 640×480 pixels.

According to the present disclosure, the fine particles are fixed to the surface of the toner base particle, thereby providing a method of manufacturing a toner in which the fine particles are less likely to be released from the surface of the toner base particles even after printing a large number of sheets.

Example

Hereinafter, the following Examples are provided to illustrate the present disclosure, but the present disclosure is not limited to these Examples. The "part" and "%" of each material in the Examples and Comparative Examples are all by mass, unless otherwise particularly stated.

<Preparation of Organosilicon Compound Solutions 1 to 9>

| | |
|---|---|
| Ion-exchange water | 90.0 parts |
| Methyltrimethoxysilane | 10.0 parts |

The above materials were weighed in a 200 mL beaker, and the pH was adjusted to 4.0 with 1 mol/L hydrochloric acid. Thereafter, heating to 60° C. was carried out in a water bath while stirring for 1 hour, thereby preparing organosilicon compound solution 1. Further, silicon compound solutions 2 to 9 were prepared in the same manner as organosilicon compound solution 1, except that the type and amount of organosilicon compound were changed as shown in the following Table 1.

TABLE 1

| | Silicon compound | Part | Silicon compound | Part |
|---|---|---|---|---|
| Silicon compound solution 1 | Methyltrimethoxysilane | 10.0 | | |
| Silicon compound solution 2 | Vinyltriethoxysilane | 10.0 | | |
| Silicon compound solution 3 | Dimethyldiethoxysilane | 10.0 | | |
| Silicon compound solution 4 | Tetraethoxysilane | 10.0 | | |
| Silicon compound solution 5 | Propyltrimethoxysilane | 10.0 | | |
| Silicon compound solution 6 | Propyltrimethoxysilane | 5.0 | Methyl-triethoxy-silane | 5.0 |
| Silicon compound solution 7 | Isobutyltrimethoxysilane | 10.0 | | |
| Silicon compound solution 8 | Phenyltrimethoxysilane | 10.0 | | |
| Silicon compound solution 9 | Ethyltriethoxysilane | 10.0 | | |

<Preparation Example of Toner Base Particle Dispersion 1>

(Preparation Example of Aqueous Medium 1)

To a reaction vessel, 390.0 parts of ion-exchange water, and 14.0 parts of sodium phosphate (dodecahydrates) (manufactured by Rasa Industries, Ltd.) were added, and incubated at 65° C. for 1.0 hour with nitrogen purging.

An aqueous calcium chloride solution of 9.2 parts of calcium chloride (dihydrate) dissolved in 10.0 parts of ion-exchange water was added in a lump, while stirring at 12,000 rpm using a T.K. homomixer (manufactured by Tokushu Kika Kogyo Co., Ltd.), thereby preparing an aqueous medium including a dispersion stabilizer. Further, 10% hydrochloric acid was added to the aqueous medium to adjust the pH to 6.0, thereby obtaining aqueous medium 1.

(Preparation Example of Polymerizable Monomer Composition 1)

| | |
|---|---|
| Styrene: | 60.0 parts |
| Coloring agent (C.I. Pigment blue 15:3) | 6.5 parts |

The above materials were added to an attritor (manufactured by NIPPON COKE & ENGINEERING CO., LTD.), and additionally dispersed at 220 rpm for 5.0 hours using zirconia particles having a diameter of 1.7 mm, thereby preparing dispersion 1 in which the pigment was dispersed.

The following materials were added to dispersion 1:

| | |
|---|---|
| Styrene | 20.0 parts |
| n-butyl acrylate | 20.0 parts |
| Polyester resin (Tg 75° C.) (condensate of polyoxypropylene(2.2)-2,2-bis(4-hydroxyphenyl)propane, terephthalic acid, and anhydrous trimellitic acid) | 5.0 parts |
| Fisher Tropsch wax (melting point 78° C.) | 7.0 parts |

These were incubated at 65° C., and uniformly dissolved and dispersed at 500 rpm using a T.K. Homomixer, thereby preparing polymerizable monomer composition 1.

(Granulation Process)

While maintaining the temperature of the aqueous medium 1 at 70° C., and the number of revolutions of the stirring apparatus at 12,000 rpm, polymerizable monomer composition 1 was added to aqueous medium 1, and 9.0 parts of t-butyl peroxypivalate as a polymerization initiator was added. The stirring was maintained at 12,000 rpm as it is with the above stirring apparatus, and granulation was performed for 10 minutes.

(Polymerization Process)

The stirrer was changed from the high speed stirring apparatus to a stirrer equipped with propeller stirring blades, and with stirring at 150 rpm, polymerization reaction was performed for 5.0 hours at 70° C., then with heating to 85° C. for 2.0 hours, thereby obtaining toner base particle dispersion 1. The weight average particle diameter (D4) of the toner base particle was 6.7 μm, and the Tg thereof was 56° C. In addition, toner base particle dispersion 1 was adjusted by adding ion-exchange water thereto, so that the concentration of the toner base particle in the dispersion was 20.0%.

<Preparation Example of Toner Particle 1>

(Process 1)

The following materials were weighed in a reaction vessel, and mixed using propeller stirring blades, thereby obtaining mixed solution 1:

| | |
|---|---|
| Organosilicon compound solution 1 | 59.0 parts |
| Fine particles (silica fine particles manufactured by a water glass method, number average particle diameter of 30.0 nm, zeta potential at pH 5.5 of −39.5 mV) | 0.5 parts |
| Toner base particle dispersion 1 | 500.0 parts |

Next, the pH of mixed solution 1 was adjusted to 5.5 (pH (A)). Thereafter, dispersion treatment was performed for 5 minutes using a table top ultrasonic cleaner disperser (Type: VS-150, manufactured by VELVO-CLEAR) having an oscillation frequency of 50 kHz and electric output at 150 W, and the fine particles in mixed solution 1 were dispersed. The temperature of mixed solution 1 was set to 70° C., which is then maintained for 1 hour, while mixing using propeller stirring blades.

(Process 2)

Thereafter, the pH of mixed solution 1 was adjusted to 8.3 using a 1 mol/L aqueous NaOH solution (pH (B)), which was maintained for 4 hours with stirring, thereby condensing the silicon compound. Then, the pH was adjusted to 1.5 using 1 mol/L hydrochloric acid, and stirring was performed for 1 hour. Thereafter, filtering was performed with washing with ion-exchange water, thereby obtaining toner particle 1 on the surface of which the fine particles exist.

<Method of Manufacturing Toner Particle 2>

Toner particle 2 was manufactured in the same manner as in the method of manufacturing toner particle 1, except the following change in the method of manufacturing toner particle 1.

(Process 1)

Silicon compound solution 1 was changed to silicon compound solution 2, and the amount of fine particles was changed from 0.5 parts to 1.0 parts, thereby obtaining mixed solution 2. Dispersion treatment was performed for 5 minutes at 15,000 rpm using a high speed stirring apparatus (CLEARMIX, manufactured by M Technique Co., Ltd.), thereby dispersing the fine particles in mixed solution 2. In addition, the conditions of processes 1 and 2 were changed as shown in the following Table 3.

<Method of Manufacturing Toner Particles 3 to 29>

In the method of manufacturing toner particle 1, the type and amount of silicon compound solution, the type and amount of fine particles, and the temperature, pH, and time of the mixed solution in process 1 were changed as shown in Tables 2 and 3, and the temperature, pH, and time in process 2 were changed as shown in Table 3. Otherwise, the same process of the method of manufacturing toner particle 1 was performed, thereby obtaining toner particles 3 to 19.

In the method of manufacturing toner particle 1, the type and amount of silicon compounds, and the type and amount of fine particles in process 1 were changed as shown in Tables 2 and 3. Then, the temperature and pH of the mixed solution in process 1 were set to be identical to those in process 2, thereby obtaining toner particles 20 to 29.

TABLE 2

| | Silicon compound | | Fine particle | | | |
|---|---|---|---|---|---|---|
| | Type | Amount [part] | Type | Zeta potential [mV] | Number average particle diameter [nm] | Amount [part] |
| Toner particle 1 | Silicon compound solution 1 | 59.0 | Silica fine particle (water glass method) | −39.5 | 30 | 0.5 |
| Toner particle 2 | Silicon compound solution 2 | 59.0 | Silica fine particle (water glass method) | −42.4 | 50 | 1.0 |

TABLE 2-continued

| | Silicon compound | | Fine particle | | | |
|---|---|---|---|---|---|---|
| | Type | Amount [part] | Type | Zeta potential [mV] | Number average particle diameter [nm] | Amount [part] |
| Toner particle 3 | Vinyltriethoxysilane | 5.9 | Silica fine particle (water glass method) | −42.4 | 50 | 1.0 |
| Toner particle 4 | Silicon compound solution 3 | 118.0 | Silica fine particle (water glass method) | −37.6 | 200 | 4.0 |
| Toner particle 5 | Silicon compound solution 4 | 59.0 | Silica fine particle (water glass method) | −37.6 | 200 | 4.0 |
| Toner particle 6 | Silicon compound solution 5 | 23.6 | Silica fine particle (water glass method) | −35.4 | 300 | 5.0 |
| Toner particle 7 | Silicon compound solution 6 | 59.0 | Silica fine particle (water glass method) | −43.4 | 100 | 1.0 |
| | | | Silica fine particle (water glass method) | −42.4 | 50 | 1.0 |
| Toner particle 8 | Silicon compound solution 7 | 23.6 | Silica fine particle (sol-gel method) | −37.6 | 200 | 4.0 |
| Toner particle 9 | Silicon compound solution 7 | 23.6 | Titanium oxide fine particle | −18.3 | 200 | 4.0 |
| Toner particle 10 | Silicon compound solution 7 | 23.6 | Alumina fine particle | 24.5 | 200 | 4.0 |
| Toner particle 11 | Silicon compound solution 7 | 23.6 | Acryl resin fine particle | −14.2 | 200 | 4.0 |
| Toner particle 12 | Silicon compound solution 8 | 5.9 | Silica fine particle (water glass method) | −38.4 | 5 | 0.3 |
| Toner particle 13 | Silicon compound solution 8 | 11.8 | Silica fine particle (water glass method) | −41.2 | 10 | 0.3 |
| Toner particle 14 | Silicon compound solution 8 | 59.0 | Silica fine particle (water glass method) | −40.5 | 20 | 0.3 |
| Toner particle 15 | Silicon compound solution 5 | 59.0 | Silica fine particle (water glass method) | −36.4 | 300 | 10.0 |
| Toner particle 16 | Silicon compound solution 5 | 59.0 | Silica fine particle (water glass method) | −33.4 | 500 | 10.0 |
| Toner particle 17 | Silicon compound solution 5 | 59.0 | Silica fine particle (water glass method) | −38.4 | 100 | 7.0 |
| Toner particle 18 | Silicon compound solution 5 | 59.0 | Silica fine particle (water glass method) | −43.4 | 100 | 20.0 |
| Toner particle 19 | Silicon compound solution 5 | 59.0 | Silica fine particle (water glass method) | −44.3 | 100 | 2.0 |
| Toner particle 20 | Silicon compound solution 5 | 59.0 | Silica fine particle (water glass method) | −45.4 | 100 | 2.0 |
| Toner particle 21 | Silicon compound solution 5 | 59.0 | Silica fine particle (water glass method) | −46.2 | 100 | 2.0 |
| Toner particle 22 | Silicon compound solution 5 | 59.0 | Silica fine particle (water glass method) | −46.8 | 100 | 2.0 |
| Toner particle 23 | Silicon compound solution 5 | 59.0 | Silica fine particle (water glass method) | −48.4 | 100 | 2.0 |
| Toner particle 24 | Silicon compound solution 5 | 59.0 | Silica fine particle (water glass method) | −48.9 | 100 | 2.0 |
| Toner particle 25 | Silicon compound solution 5 | 59.0 | Silica fine particle (water glass method) | −43.4 | 100 | 2.0 |
| Toner particle 26 | Silicon compound solution 5 | 59.0 | Silica fine particle (water glass method) | −49.8 | 100 | 2.0 |
| Toner particle 27 | None | None | Silica fine particle (water glass method) | −46.8 | 100 | 4.0 |
| Toner particle 28 | Silicon compound solution 8 | 23.6 | None | None | None | None |
| Toner particle 29 | Silicon compound solution 5 | 59.0 | Silica fine particle (water glass method, HMDS treatment) | −1.2 | 100 | 2.0 |

HMDS treatment . . . hexamethyldisilazane treatment

Toner particle 3: vinyltriethoxysilane was added without hydrolysis

TABLE 3

| | Process 1·2 | Process 1 | | Process 2 | |
|---|---|---|---|---|---|
| | Temperature | pH (A) | Time | pH (B) | Time |
| Toner particle 1 | 70 | 5.5 | 1.0 | 8.3 | 4.0 |
| Toner particle 2 | 80 | 5.5 | 0.5 | 9.2 | 2.0 |
| Toner particle 3 | 80 | 5.5 | 0.5 | 9.3 | 2.0 |
| Toner particle 4 | 70 | 5.5 | 2.0 | 9.4 | 3.0 |
| Toner particle 5 | 90 | 5.5 | 1.0 | 9.1 | 5.0 |
| Toner particle 6 | 90 | 5.5 | 1.0 | 9.2 | 4.0 |
| Toner particle 7 | 90 | 5.5 | 3.0 | 9.4 | 5.0 |

TABLE 3-continued

| | Process 1·2 | Process 1 | | Process 2 | |
|---|---|---|---|---|---|
| | Temperature | pH (A) | Time | pH (B) | Time |
| Toner particle 8 | 90 | 5.5 | 2.0 | 9.3 | 2.0 |
| Toner particle 9 | 90 | 5.5 | 2.0 | 9.8 | 2.0 |
| Toner particle 10 | 90 | 5.5 | 2.0 | 9.6 | 2.0 |
| Toner particle 11 | 90 | 5.5 | 2.0 | 9.4 | 2.0 |
| Toner particle 12 | 90 | 5.5 | 2.0 | 9.1 | 0.5 |
| Toner particle 13 | 90 | 5.5 | 2.0 | 8.9 | 0.5 |
| Toner particle 14 | 105 | 5.5 | 2.0 | 9.1 | 0.5 |

TABLE 3-continued

| | Process 1·2 | Process 1 | | Process 2 | |
|---|---|---|---|---|---|
| | Temperature | pH (A) | Time | pH (B) | Time |
| Toner particle 15 | 105 | 5.5 | 2.0 | 9.2 | 5.0 |
| Toner particle 16 | 105 | 5.5 | 2.0 | 9.1 | 5.0 |
| Toner particle 17 | 90 | 4.3 | 2.0 | 9.1 | 2.0 |
| Toner particle 18 | 90 | 5.5 | 2.0 | 9.2 | 2.0 |
| Toner particle 19 | 90 | 6.2 | 2.0 | 9.1 | 2.0 |
| Toner particle 20 | 90 | 7.3 | 0.0 | 7.3 | 5.0 |
| Toner particle 21 | 90 | 8.2 | 0.0 | 8.2 | 5.0 |
| Toner particle 22 | 90 | 9.4 | 0.0 | 9.4 | 5.0 |
| Toner particle 23 | 90 | 10.4 | 0.0 | 10.4 | 5.0 |
| Toner particle 24 | 90 | 11.2 | 0.0 | 11.2 | 5.0 |
| Toner particle 25 | 90 | 5.3 | 0.0 | 5.3 | 5.0 |
| Toner particle 26 | 90 | 12.5 | 0.0 | 12.5 | 5.0 |
| Toner particle 27 | 90 | 9.4 | 0.0 | 9.4 | 5.0 |
| Toner particle 28 | 90 | 9.3 | 0.0 | 9.3 | 5.0 |
| Toner particle 29 | 90 | 9.1 | 0.0 | 9.1 | 5.0 |

Toner particles 1 to 30 obtained as described above were evaluated as follows.

<Calculation Method of Embedding Rate of Fine Particle to Toner Base Particle>

Figure 3:
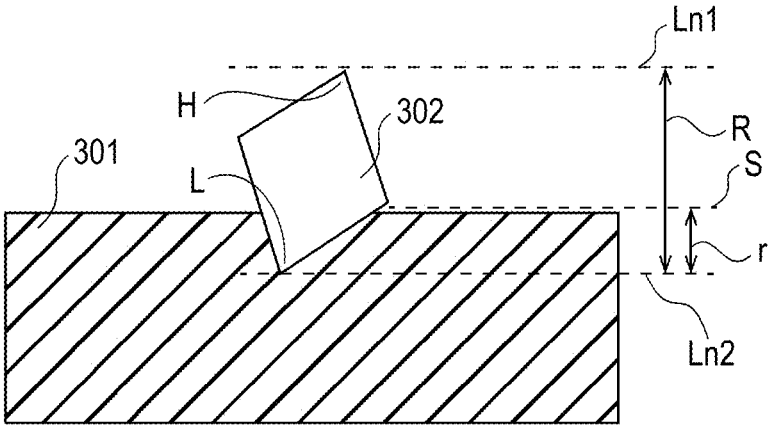
FIG. 3 is a diagram for describing a procedure for calculating an embedding rate of fine particles from a cross-sectional image.

The embedding rate of the fine particle to the toner base particle is calculated from cross section observation of the toner base particle using a transmission electron microscope (TEM) (product name: JEM2800, manufactured by JEOL Ltd.). After sufficiently dispersing the toner in a visible light-curable embedding resin (product name: D-800, manufactured by Toagosei Co., Ltd.), visible light was emitted using a light irradiator (product name: LUXSPOT II, manufactured by JEOL Ltd.), and the visible light-curable embedding resin was cured, thereby obtaining a cured product. The obtained cured product was cut into a foil-shaped sample using a microtome equipped with diamond blades. This sample was magnified to a magnification at 100,000 times using the transmission electron microscope at an acceleration voltage of 20 kV to observe the cross section of the toner. The calculation was performed from the obtained image in the following order: Calculate the embedding rate of the fine particle, based on the fine particle diameter, R, the fine particle embedding length, r, and the following Equation (FIG. 3).

Herein, the toner base particle surface, S is regarded as being a straight line. Though the surface of the toner particle magnified to 100,000 times was somewhat rough, almost a straight line is observed, and thus, the surface of the toner base particle is regarded as being a straight line.

$$\text{Embedding rate [\%]}=(r/R)\times 100$$

Fine particle diameter R: a distance between the following line Ln 1 and line Ln 2.

Fine particle embedding length r: a distance between the surface S of the toner base particle 301 and the straight line Ln 2.

Line Ln 1: a line passing through the highest point H of the fine particle 302 embedded in the toner base particle 301 and at the same time being parallel to the surface S of the toner base particle 301.

Highest point H: a farthest point from the surface S of the toner base particle 301, among the portions of the fine particle 302 embedded in the toner base particle 301, which are not embedded in the toner base particle 301.

Line Ln 2: a line passing through the lowest point L of the fine particle 302 embedded in the toner base particle 301 and at the same time being parallel to the surface S of the toner base particle 301.

Lowest point L: a farthest point from the surface S of the toner base particle 301, among the portions of the fine particle 302 embedded in the toner base particle 301, which are embedded in the toner base particle 301.

One hundred fine particles were observed to calculate the embedding rate of each fine particle, and the arithmetic average thereof was the embedding rate of the fine particle in the toner.

A: embedding rate of fine particle is equal to or more than 50%

B: embedding rate of fine particle is equal to or more than 20% and less than 50%

C: embedding rate of fine particle is less than 20%

<Dispersibility of Fine Particle>

The toner particle was observed with SEM (scanning electron microscope) to evaluate the dispersibility of the fine particles. When evaluating the dispersibility, 50 fine particles were observed per one toner particle. This was carried out for 10 toner particles. That is, 500 fine particles were observed.

When any fine particle was noted, and the distance between the noted fine particle and other fine particle closest to the noted particle was 5 nm or more, the noted fine particle was considered as being "a fine particle present alone".

In addition, when each of 10 or more fine particles was in contact with other two or more fine particles to be integrated, it was determined to be "10 or more fine particles being aggregated".

Then, the dispersibility of the fine particle was evaluated, based on "the ratio of the fine particles present alone" and "whether 10 or more fine particles are aggregated".

$$\text{Ratio of fine particles present alone (\%)}=((\text{the number of fine particles present alone})/500)\times 100$$

Ranks were assigned, based on "the ratio of the fine particles present alone", and "whether 10 or more fine particles are aggregated or not".

A: the ratio of the fine particles present alone is equal to or more than 80% (e.g., FIG. 1).

B: the ratio of the fine particles present alone is equal to or more than 50% and less than 80%.

C: the ratio of the fine particles present alone is less than 50%, but 10 or more fine particles are not aggregated. (e.g., FIG. 4).

D: the ratio of the fine particles present alone is less than 50%, and 10 or more fine particles are aggregated. (e.g., FIG. 5).

Figure 4:
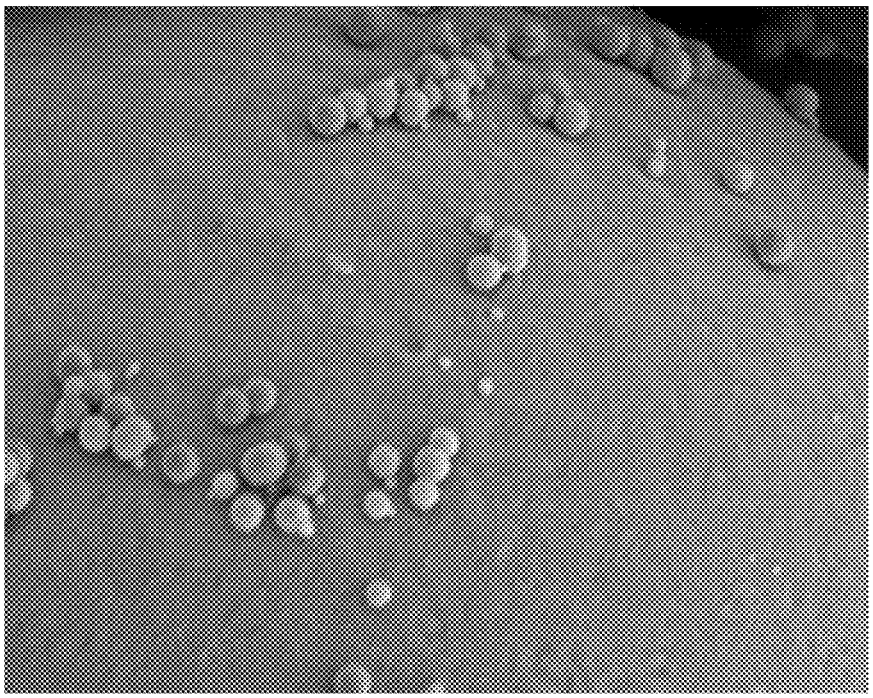
FIG. 4 is a microphotograph of a surface of a toner particle representing an example of less than 50% of fine particles existing alone.
Figure 5:
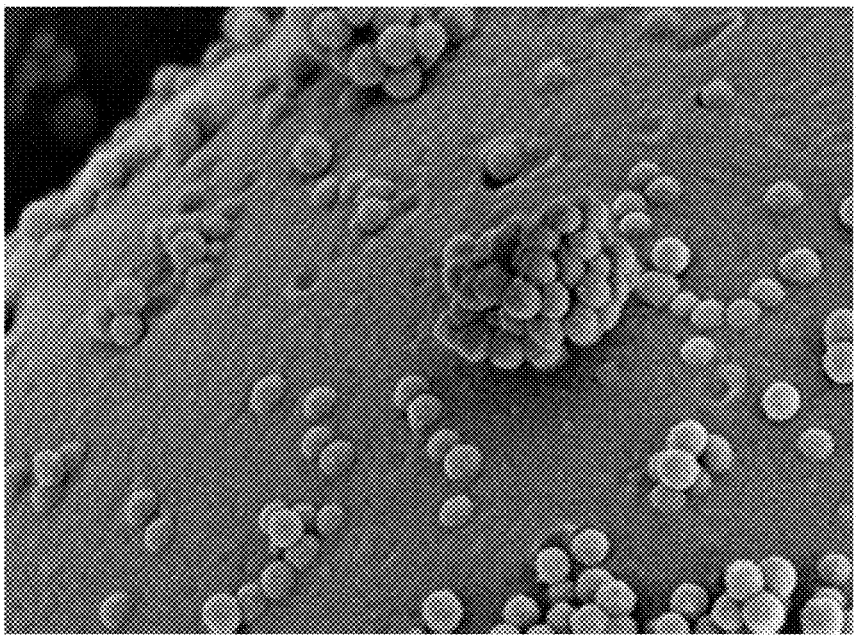
FIG. 5 is a microphotograph of a surface of a toner particle representing an example of aggregated 10 or more fine particles.

Further, FIGS. 1, 4 and 5 are the example of the surface image of the toner particles obtained using SEM (magnification: 50,000 times).

<Fine Particle Release Rate>

To a 50 mL vial with a cap, 20.0 g of zirconia beads (diameter: 0.05 mm) and 1.0 g of an evaluation toner were added, and stirred at 200 rpm for 1 hour, using a shaker (Model-YS, manufactured by YAYOI Co., Ltd.). The toner was observed with SEM (magnification: 50,000 times) before and after stirring, and the number of the fine particles was measured by one portion per one toner particle, in the region of a square of 300 μm. Ten toner particles were observed, and the release rate of the fine particles from each toner particle was calculated by the following Equation, and the addition average value thereof was determined to be the fine particle release rate of each toner.

$$\text{Fine particle release rate}=(N_{before}-N_{after})/N_{before}$$

$N_{before}$: the number of fine particles observed before stirring $N_{after}$: the number of fine particles observed after stirring Ranks were assigned, as shown below, based on the calculated fine particle release rate.

A: fine particle release rate less than 10%

B: fine particle release rate equal to or more than 10% and less than 20%

C: fine particle release rate equal to or more than 20% and less than 50%

D: fine particle release rate equal to or more than 50%

The above evaluation results are shown in Table 4

TABLE 4

| | | Embedding rate of fine particle (%) | | Dispersibility of fine particle (%) | | Release rate of fine particle (%) | |
|---|---|---|---|---|---|---|---|
| Example 1 | Toner particle 1 | A | 55 | A | 96 | A | 8 |
| Example 2 | Toner particle 2 | A | 62 | A | 94 | A | 7 |
| Example 3 | Toner particle 3 | A | 64 | A | 92 | A | 8 |
| Example 4 | Toner particle 4 | A | 58 | A | 93 | A | 7 |
| Example 5 | Toner particle 5 | B | 34 | A | 94 | B | 18 |
| Example 6 | Toner particle 6 | A | 53 | A | 92 | A | 6 |
| Example 7 | Toner particle 7 | A | 56 | A | 88 | A | 7 |
| Example 8 | Toner particle 8 | A | 64 | A | 94 | A | 6 |
| Example 9 | Toner particle 9 | B | 48 | A | 86 | A | 8 |
| Example 10 | Toner particle 10 | B | 44 | A | 84 | A | 7 |
| Example 11 | Toner particle 11 | B | 32 | B | 68 | B | 17 |
| Example 12 | Toner particle 12 | A | 72 | C | 48 | A | 2 |
| Example 13 | Toner particle 13 | A | 68 | B | 54 | A | 4 |
| Example 14 | Toner particle 14 | A | 64 | B | 58 | A | 5 |
| Example 15 | Toner particle 15 | B | 36 | A | 93 | B | 17 |
| Example 16 | Toner particle 16 | B | 21 | A | 81 | C | 32 |
| Example 17 | Toner particle 17 | A | 55 | A | 88 | A | 7 |
| Example 18 | Toner particle 18 | B | 26 | A | 68 | B | 18 |
| Example 19 | Toner particle 19 | A | 64 | A | 92 | A | 7 |
| Example 20 | Toner particle 20 | B | 34 | C | 41 | C | 24 |
| Example 21 | Toner particle 21 | A | 58 | B | 68 | A | 8 |
| Example 22 | Toner particle 22 | A | 56 | B | 62 | A | 6 |
| Example 23 | Toner particle 23 | A | 61 | B | 58 | A | 7 |
| Example 24 | Toner particle 24 | A | 57 | C | 38 | A | 5 |
| Comp. Ex. 1 | Toner particle 25 | C | 12 | C | 28 | D | 62 |
| Comp. Ex. 2 | Toner particle 26 | C | 18 | D | 18 | A | 5 |
| Comp. Ex. 3 | Toner particle 27 | C | 13 | D | 14 | D | 72 |
| Comp. Ex. 4 | Toner particle 28 | Convex portion was not confirmed | | Convex portion was not confirmed | | Convex portion was not confirmed | |
| Comp. Ex. 5 | Toner particle 29 | C | 18 | D | 8 | C | 32 |

<Charge Quantity>

To a 50 mL plastic bottle with a cap, 19.0 g of a magnetic carrier, F813-300 (manufactured by Powdertech Co., Ltd.), and 1.0 g of an evaluation toner were added. Then, shaking was performed for 1 minute at a speed of 4 reciprocations for 1 second, using a shaker (type: YS-LD, manufactured by YAYOI Co., Ltd.), thereby preparing a two-component developer.

Figure 6:
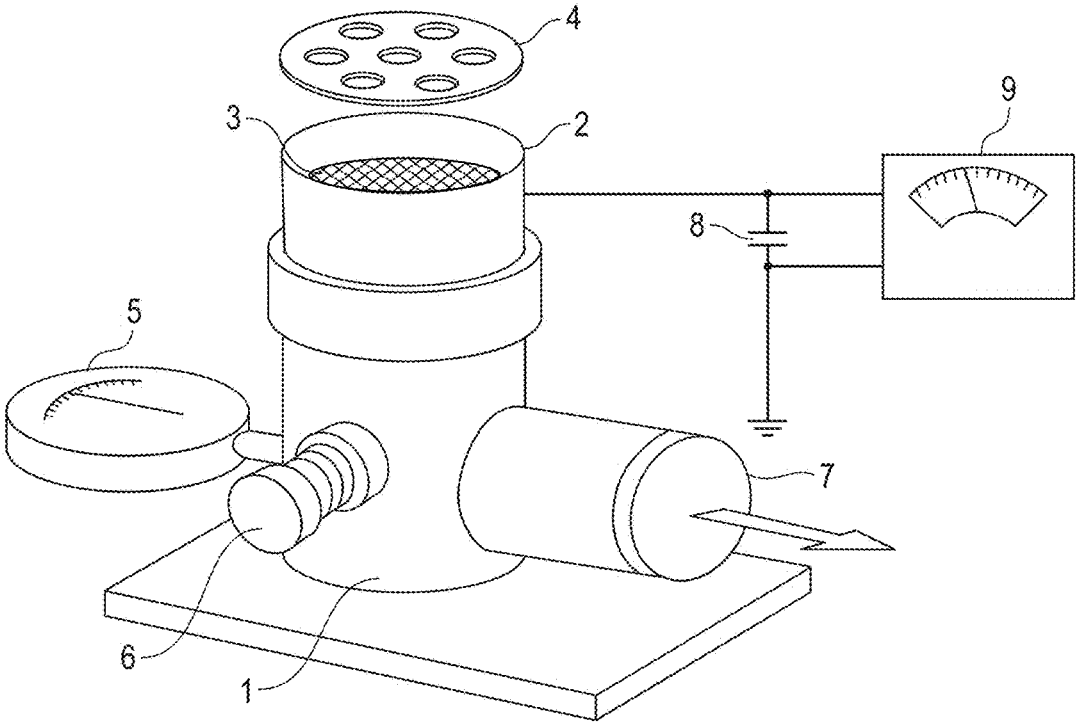
FIG. 6 is a schematic diagram of an apparatus for measuring a charge quantity.

As shown in FIG. 6, to a measuring container 2 made of metal with a 500 mesh screen 3 (hole size: 25 μm) on the bottom, 0.200 g of the two-component developer for measuring a triboelectric charge quantity was added, and the cap 4 made of metal was closed. Herein, the entire weight of the measuring container 2 was weighed, which was W1 (g). Next, the portion in contact with the measuring container 2 was sucked from a suction port 7, at least in an aspirator 1 which is an insulator, and an air volume control valve 6 was adjusted to set the pressure of the vacuum gauge 5 to 50 mmAq (1 mmAq=9.80665 Pa). Suction was performed for 1 minute in this state to remove the toner by suction.

The potential of an electrometer 9 at this time was set to V (volt). The capacitance of a capacitor 8 was set to C (μF). The entire weight of the measuring container after suction was weighed, which was W2 (g). The triboelectric charge quantity of this toner was calculated by the following equation:

$$\text{Triboelectric charge quantity (mC/kg)}=(C\times V)/(W1-W2)$$

Ranks were assigned, as shown below, based on the calculated triboelectric charge quantity.

A: the triboelectric charge quantity is equal to or less than −30 mC/kg.

B: the triboelectric charge quantity is more than −30 mC/kg and equal to or less than −20 mC/kg.

C: the triboelectric charge quantity is more than −20 mC/kg and equal to or less than −15 mC/kg.

D: the triboelectric charge quantity is more than −15 mC/kg.

The above evaluation results are shown in Table 5.

TABLE 5

| | | Charge quantity (mC/kg) | |
|---|---|---|---|
| Example 19 | Toner particle 19 | A | −34 |
| Example 20 | Toner particle 20 | C | −16 |
| Example 21 | Toner particle 21 | B | −26 |
| Example 22 | Toner particle 22 | B | −24 |
| Example 23 | Toner particle 23 | B | −25 |
| Example 24 | Toner particle 24 | C | −18 |
| Comp. Ex. 1 | Toner particle 25 | D | −8 |
| Comp. Ex. 2 | Toner particle 26 | D | −12 |

<Method of Manufacturing Toner Particle Precursor Dispersion 1>

(Preparation Process of Aqueous Medium 1)

To 390.0 parts of ion-exchange water in a reaction vessel, 14.0 parts of sodium phosphate (dodecahydrates) (manufactured by Rasa Industries, Ltd.) were added, and incubated at 65° C. for 1.0 hour with nitrogen purging.

An aqueous calcium chloride solution of 9.2 parts of calcium chloride (dihydrate) dissolved in 10.0 parts of ion-exchange water was added in a lump, while stirring at 12,000 rpm using a T.K. homomixer, thereby preparing an aqueous medium including a dispersion stabilizer.

Further, 10% hydrochloric acid was added to the aqueous medium to adjust the pH to 6.0, thereby obtaining aqueous medium 1.

(Preparation Process of Polymerizable Monomer Composition)

| | |
|---|---|
| Styrene: | 60.0 parts |
| Coloring agent (C.I. Pigment blue 15:3) | 6.5 parts |

The above materials were added to an attritor (manufactured by NIPPON COKE & ENGINEERING CO., LTD.), and additionally dispersed at 220 rpm for 5.0 hours using zirconia particles having a diameter of 1.7 mm, thereby preparing dispersion in which the pigment was dispersed.

| | |
|---|---|
| Styrene | 20.0 parts |
| n-butyl acrylate | 20.0 parts |
| Polyester resin (Tg 75° C.) (condensate of polyoxypropylene(2.2)-2,2-bis(4-hydroxyphenyl)-propane, terephthalic acid, and anhydrous trimellitic acid) | 5.0 parts |
| Fisher Tropsch wax (melting point 78° C.) | 7.0 parts |

To the dispersion, the above materials were added, incubated at 65° C., uniformly dissolved and dispersed at 500 rpm using a T.K. Homomixer, thereby preparing a polymerizable monomer composition.

(Granulation Process)

While maintaining the temperature of the aqueous medium 1 at 70° C., and the number of revolutions of the stirring apparatus at 12,000 rpm, the polymerizable monomer composition was added to aqueous medium 1, and 9.0 parts of t-butyl peroxypivalate as a polymerization initiator was added. The stirring was maintained at 12,000 rpm as it is with the above stirring apparatus, and granulation was performed for 10 minutes, thereby obtaining toner particle precursor dispersion 1. Ion-exchange water was added to adjust the concentration of the toner particle precursor in the dispersion to be 20.0%.

<Method of Preparing Fine Particle Dispersion 1>

| | |
|---|---|
| Fine particles (silica manufactured by a water glass method, number average particle diameter of 200 nm, zeta potential at pH 5.5 of −37.6 mV) | 40.0 parts |
| Ion-exchange water | 60.0 parts |

After the above materials were weighed and mixed, dispersion treatment was performed for 5 minutes using a table top ultrasonic cleaner disperser (Type: VS-150, manufactured by VELVO-CLEAR) having an oscillation frequency of 50 kHz and electric output at 150 W to obtain fine particle dispersion 1.

<Fine Particle Dispersions 2 to 8>

Fine particle dispersions 2 to 8 were prepared by changing the type of fine particles as shown in Table 6.

TABLE 6

| | Type | Zeta potential [mV] (pH 5.5) | Number average particle diameter [nm] |
|---|---|---|---|
| Fine particle dispersion 1 | Silica fine particle (water glass method) | −37.6 | 200 |
| Fine particle dispersion 2 | Titanium oxide fine particle | −18.3 | 200 |
| Fine particle dispersion 3 | Alumina fine particle | 24.5 | 200 |
| Fine particle dispersion 4 | Acryl resin fine particle | −14.2 | 200 |
| Fine particle dispersion 5 | Silica fine particle (water glass method) | −38.4 | 5 |
| Fine particle dispersion 6 | Silica fine particle (water glass method) | −41.2 | 10 |
| Fine particle dispersion 7 | Silica fine particle (water glass method) | −43.4 | 100 |
| Fine particle dispersion 8 | Silica fine particle (water glass method) | −33.4 | 500 |

<Method of Manufacturing Toner Particle 31>

(Process 3)

The following materials were weighed in a reaction vessel, and mixed using propeller stirring blades.

Silicon compound solution 5: 50.0 parts Fine particle dispersion 1: 10.0 parts Toner particle precursor dispersion 1:500.0 parts Next, the pH of mixed solution 1 was adjusted to 5.5.

(Polymerization Process)

A polymerization reaction was performed by maintaining the temperature at 70° C. for 5.0 hours while stirring at 150 rpm using propeller stirring blades, and then heating to a higher temperature of 85° C., and maintaining the temperature for 2.0 hours. Thereafter, the temperature of the mixed solution was raised to 90° C., which was maintained, while mixing was performed for 1 hour using the propeller stirring blades.

(Process 4)

Thereafter, the pH was adjusted to 9.2 using a 1 mol/L aqueous NaOH solution, which was maintained for 4 hours with stirring.

After adjusting the pH to 1.5 using 1N hydrochloric acid and stirring for 1 hour, filtering was performed with washing with ion-exchange water, thereby obtaining toner particle 31 on the surface of which fine particles exist.

<Method of Manufacturing Toner Base Particle Dispersion 2>

(Resin Fine Particle Dispersion)

The following materials were weighed, and mixed and dissolved.

| | |
|---|---|
| Styrene | 82.6 parts |
| n-butyl acrylate | 9.2 parts |
| Acrylic acid | 1.3 parts |
| Hexanediol acrylate | 0.4 parts |
| n-lauryl mercaptan | 3.2 parts |

To this solution, a 10% aqueous solution of an anionic surfactant (product name: Neogen RK, manufactured by DKS Co., Ltd.) was added, and dispersed therein. Further, an aqueous solution of 0.15 parts of potassium persulfate dissolved in 10.0 parts of ion-exchange water was added, with slow stirring for 10 minutes. After nitrogen substitution, emulsion polymerization was performed at a temperature of 70° C. for 6.0 hours. After completing the polymerization, the reaction solution was cooled to room temperature, and ion-exchange water was added thereto, thereby obtaining a resin fine particle dispersion having a solid content of 12.5%, and a median diameter by volume of 0.2 μm.

(Wax Dispersion)

The following materials were weighed and mixed:

| | |
|---|---|
| Ester wax (melting point 70° C.) | 100.0 parts |
| Anionic surfactant (product name: Neogen RK, DKS Co., Ltd.) | 15.0 parts |
| Ion-exchange water | 385.0 parts |

Dispersion was performed for 1 hour using a wet jet mill (product name: Nano Jet Pul JN 100, manufactured by JOKOH CO., LTD.) to obtain a wax dispersion. The concentration of the wax particle dispersion was 20.0%.

(Coloring Agent Dispersion)

The following materials were weighed and mixed:

| | |
|---|---|
| Coloring agent (C.I. Pigment blue 15:3) | 100.0 parts |
| Anionic surfactant (product name: Neogen RK, DKS Co., Ltd.) | 15.0 parts |
| Ion-exchange water | 885.0 parts |

Dispersion was performed for 1 hour using a wet jet mill (product name: Nano Jet Pul JN 100, manufactured by JOKOH CO., LTD.) to obtain a coloring agent dispersion.

| | |
|---|---|
| Resin particle dispersion | 160.0 parts |
| Wax dispersion | 10.0 parts |
| Coloring agent dispersion | 10.0 parts |
| Magnesium sulfate | 0.2 parts |

The above materials were dispersed using a homogenizer (product name: ULTRA TURRAX T50, manufactured by IKA), and then heated to 65° C. with stirring. After stirring at 65° C. for 1.0 hour, it was confirmed from observation with an optical microscope that aggregate particles having a number average particle diameter of 6.0 μm were formed. After adding 2.2 parts of an anionic surfactant (product name: Neogen RK, DKS Co., Ltd.), heating to 80° C., and stirring for 2.0 hours were performed to obtain fused spherical toner base particles. Solid which was filtered and separated after being cooled was stirred and washed with 720.0 parts of ion-exchange water for 1.0 hour. The solution containing the toner base particles was filtered and dried using a vacuum dryer, thereby obtaining toner base particle 2. The weight average particle diameter (D4) of toner base particle 2 was 7.1 μm, and the Tg thereof was 58° C.

To 390.0 parts of ion-exchange water in a vessel, 14.0 parts of sodium phosphate (dodecahydrates) (manufactured by Rasa Industries, Ltd.) were added, and incubated at 65° C. for 1.0 hour with nitrogen purging. An aqueous calcium chloride solution of 9.2 parts of calcium chloride (dihydrate) dissolved in 10.0 parts of ion-exchange water was added in a lump, while stirring at 12,000 rpm using a T.K. homomixer, thereby preparing an aqueous medium including a dispersion stabilizer. Further, 10% hydrochloric acid was added to the aqueous medium to adjust the pH to 6.0, and an aqueous medium was prepared.

To the aqueous medium, 100.0 parts of toner base particle 2 was added, and dispersed at a temperature of 60° C. for 15 minutes while rotating at 5,000 rpm using a T.K. homomixer. Ion-exchange water was added so that the concentration of the toner base particle in the dispersion is adjusted to 20.0%, thereby obtaining toner base particle dispersion 2.

<Method of Manufacturing Toner Base Particle Dispersion 3>

| | |
|---|---|
| Ion-exchange water | 660.0 parts |
| 48.5% aqueous sodium dodecyldiphenyletherdisulfonate solution | 25.0 parts |

The above materials were mixed, and stirred at 10,000 rpm using a T.K. homomixer to prepare an aqueous medium.

The following materials were added to 500.0 parts of ethyl acetate, and dissolved at 100 rpm with a propeller type stirring apparatus to prepare a dissolved solution.

| | |
|---|---|
| Styrene/butyl acrylate copolymer (copolymerization mass ratio: 80/20) | 100.0 parts |
| Saturated polyester resin (terephthalic acid-propylene oxide modified bisphenol A copolymer) | 3.0 parts |
| Coloring agent (C.I. Pigment blue 15:3) | 6.5 parts |
| Fisher Tropsch wax (melting point 78° C.) | 9.0 parts |

Next, 150.0 parts of the aqueous medium was added to a container, and stirred at the number of revolutions of 12,000 rpm using a T.K. homomixer, and 100.0 parts of the dissolved solution was added thereto, and mixed for 10 minutes, thereby preparing emulsion slurry.

Thereafter, to a flask equipped with a pipe for degassing, a stirrer and a thermometer, 100.0 parts of the emulsion slurry was added, and was desolvated by allowing it to stand under reduced pressure at a temperature of 30° C. for 12 hours, while stirring at a stirring peripheral speed of 20 m/min, and aged at a temperature of 45° C. for 4 hours, thereby obtaining desolvated slurry. After filtering the desolvated slurry under reduced pressure, 300.0 parts of ion-exchange water was added to the obtained filtered cake, and mixed and redispersed with a T.K. homomixer (at the number of revolutions of 12,000 rpm for 10 minutes), and then filtered.

The thus-obtained filtered cake was dried at a temperature of 45° C. for 48 hours with a dryer, and filtered with a mesh having a hole size of 75 μm, thereby obtaining toner base particle 3. The weight average particle diameter (D4) of toner base particle 3 was 6.9 μm, and the Tg thereof was 55° C.

To 390.0 parts of ion-exchange water in a reaction vessel, 14.0 parts of sodium phosphate (dodecahydrates) (manufactured by Rasa Industries, Ltd.) were added, and incubated at 65° C. for 1.0 hour with nitrogen purging. An aqueous calcium chloride solution of 9.2 parts of calcium chloride (dihydrate) dissolved in 10.0 parts of ion-exchange water was added in a lump, while stirring at 12,000 rpm using a T.K. homomixer, thereby preparing an aqueous medium including a dispersion stabilizer. Further, 10% hydrochloric acid was added to the aqueous medium to adjust the pH to 6.0, and an aqueous medium was prepared.

To the aqueous medium, 100.0 parts of toner base particle 3 was added, and dispersed at a temperature of 60° C. for 15 minutes while rotating at 5,000 rpm using a T.K. homomixer. Ion-exchange water was added so that the concentration of the toner base particle in the dispersion is adjusted to 20.0%, thereby obtaining toner base particle dispersion 3.

<Method of Manufacturing Toner Base Particle Dispersion 4>

The following materials were weighed, in a reaction vessel equipped with a cooling pipe, a stirrer, and a nitrogen inlet tube:

| | |
|---|---|
| Terephthalic acid | 29.0 parts |
| Polyoxypropylene(2,2)-2,2-Bis(4-hydroxyphenyl)propane | 80.0 parts |
| Titanium dihydroxy bis(triethanol aminate) | 0.1 parts |

Thereafter, they were heated to 200° C., and reacted for 9 hours, while removing water produced with introduction of nitrogen. Further, 5.8 parts of anhydrous trimellitic acid was added, heated to 170° C., and reacted for 3 hours, thereby synthesizing a polyester resin.

Low-density polyethylene (melting point 100° C.)

| | |
|---|---|
| Low-density polyethlyene (melting point 100° C. | 20.0 parts |
| Styrene | 64.0 parts |
| n-butyl acrylate | 13.5 parts |
| Acrylonitrile | 2.5 parts |

In addition, the materials were added to an autoclave, the system was $N_2$-substituted, and then heated to 180° C. with stirring, and maintained. To the system, 50.0 parts of a xylene solution of 2.0% t-butylhydroperoxide was continuously added dropwise for 4.5 hours, and the solvent was removed by separation after cooling, thereby obtaining a graft polymer in which a copolymer is grafted on polyethylene.

Polyester resin (condensate of polyoxypropylene(2.2)-2,2-bis(4-hydroxyphenyl)propane, terephthalic acid, and anhydrous trimellitic acid) 100.0 parts

| | |
|---|---|
| Paraffin wax (melting point 75° C.) | 5.0 parts |
| Graft polymer | 5.0 parts |
| Coloring agent (C.I. Pigment blue 15:3) | 5.0 parts |

The above materials were well-mixed with a Mitsui Henschel mixer (FM-75 model, manufactured by Mitsui Miike Chemical Engineering Machinery, Co., Ltd.), and melt-kneaded with a twin-screw kneader (PCM-30 model, manufactured by Ikegai Ironworks Corp.) set at a temperature of 100° C. The thus-obtained kneaded product was cooled, and coarsely crushed to 1 mm or less with a hammer mill, thereby obtaining a coarsely crushed product. Next, the obtained coarsely crushed product was pulverized using a turbo mill (T-250: RSS rotor/SNB liner) manufactured by FREUND-TURBO CORPORATION to obtain a pulverized product of about 5 μm, and then additionally, the fine course powder was cut with a multi-division classifier using a Coanda effect, thereby obtaining toner base particle 4. The weight average particle diameter (D4) of toner base particle 4 was 6.4 μm, and the Tg thereof was 59° C.

To 390.0 parts of ion-exchange water in a vessel, 14.0 parts of sodium phosphate (dodecahydrates) (manufactured by Rasa Industries, Ltd.) were added, and incubated at 65° C. for 1.0 hour with nitrogen purging. An aqueous calcium chloride solution of 9.2 parts of calcium chloride (dihydrate) dissolved in 10.0 parts of ion-exchange water was added in a lump, while stirring at 12,000 rpm using a T.K. homomixer, thereby preparing an aqueous medium including a dispersion stabilizer. Further, 10% hydrochloric acid was added to the aqueous medium to adjust the pH to 6.0, thereby preparing an aqueous medium.

To the aqueous medium, 200.0 parts of toner base particle 4 was added, and dispersed at a temperature of 60° C. for 15 minutes while rotating at 5,000 rpm using a T.K. homomixer. Ion-exchange water was added so that the concentration of toner base particle 4 in the dispersion is adjusted to 20.0%, thereby obtaining toner base particle dispersion 4.

<Method of Manufacturing Toner Particle 32>

(Process 3)

The following materials were weighed in a reaction vessel, and mixed using propeller stirring blades.

| | |
|---|---|
| Silicon compound solution 2 | 50.0 parts |
| Fine particle dispersion 1 | 10.0 parts |
| Toner base particle dispersion 1 | 500.0 parts |

Next, the pH of the mixed solution was adjusted to 5.5. The temperature of the mixed solution was set to 80° C., which is then maintained for 1 hour, with mixing using propeller stirring blades.

(Process 4)

Thereafter, the pH was adjusted to 9.2 using a 1 N aqueous NaOH solution, which was maintained for 4 hours with stirring. Then, the pH was adjusted to 1.5 using 1 N hydrochloric acid, and stirring was performed for 1 hour. Thereafter, filtering was performed with washing with ion-exchange water, thereby obtaining toner particle 32 on the surface of which the fine particles exist.

<Method of Manufacturing Toner Particles 33 to 45>

Toner particles 33 to 45 were obtained in the same manner as in the method of manufacturing toner particle 32, except that the type of toner base particle dispersion, the type and amount of silicon compound solution, and the type and amount of fine particle dispersion in process 3, and the temperature in processes 3 and 4 were changed as shown in Table 7.

TABLE 7

| | Process 3 | | | | | |
|---|---|---|---|---|---|---|
| | | Silicon compound | | Fine particle | | |
| | Toner base particle Type | Type | Amount [part] | Type | Amount [part] | Process 3, 4 Temperature [° C.] |
| Toner particle 32 | Toner base particle dispersion 1 | Silicon compound solution 2 | 50.0 | Fine particle dispersion 1 | 10.0 | 80 |
| Toner particle 33 | Toner base particle dispersion 2 | Silicon compound solution 2 | 50.0 | Fine particle dispersion 1 | 10.0 | 80 |
| Toner particle 34 | Toner base particle dispersion 3 | Silicon compound solution 9 | 50.0 | Fine particle dispersion 1 | 10.0 | 90 |
| Toner particle 35 | Toner base particle dispersion 4 | Silicon compound solution 5 | 50.0 | Fine particle dispersion 1 | 10.0 | 90 |
| Toner particle 36 | Toner base particle dispersion 4 | Propyltrimethoxysilane | 5.0 | Fine particle dispersion 1 | 10.0 | 90 |
| Toner particle 37 | Toner base particle dispersion 1 | Silicon compound solution 5 | 2.0 | Fine particle dispersion 2 | 10.0 | 90 |
| Toner particle 38 | Toner base particle dispersion 1 | Silicon compound solution 5 | 2.0 | Fine particle dispersion 3 | 10.0 | 90 |
| Toner particle 39 | Toner base particle dispersion 1 | Silicon compound solution 5 | 50.0 | Fine particle dispersion 4 | 10.0 | 90 |
| Toner particle 40 | Toner base particle dispersion 1 | Silicon compound solution 8 | 5.0 | Fine particle dispersion 5 | 0.8 | 90 |
| Toner particle 41 | Toner base particle dispersion 1 | Silicon compound solution 8 | 10.0 | Fine particle dispersion 6 | 0.8 | 90 |
| Toner particle 42 | Toner base particle dispersion 1 | Silicon compound solution 9 | 5.0 | Fine particle dispersion 7 | 0.3 | 90 |

TABLE 7-continued

| | | Process 3 | | | | |
|---|---|---|---|---|---|---|
| | | Silicon compound | | Fine particle | | |
| | Toner base particle Type | Type | Amount [part] | Type | Amount [part] | Process 3, 4 Temperature [° C.] |
| Toner particle 43 | Toner base particle dispersion 1 | Silicon compound solution 9 | 5.0 | Fine particle dispersion 8 | 100.0 | 105 |
| Toner particle 44 | Toner base particle dispersion 1 | None | 0.0 | Fine particle dispersion 7 | 10.0 | 90 |
| Toner particle 45 | Toner base particle dispersion 1 | Silicon compound solution 8 | 5.0 | None | 12.5 | 90 |

Toner particle 36: propyltrimethoxysilane was added without hydrolysis

<Method of Manufacturing Toner Particle 46>

Above toner base particle 1: 100.0 parts and 4.0 parts of the following fine particles were mixed at 3,000 rpm for 15 minutes, using a Mitsui Hensel MIXER (Model FM-75, manufactured by Mitsui Miike Kakoki Co., Ltd.), thereby obtaining a toner base particle having fine particles attached thereto.

The fine particles (silica fine particles manufactured by a water glass method, having a surface hydrophobized by HMDS (hexamethyldisilazane), a number average particle diameter of 200 nm)

The following materials were weighed in a reaction vessel, and fine particle dispersion 46 was obtained using propeller stirring blades.

| | |
|---|---|
| Ion-exchange water | 90.0 parts |
| Methanol | 210.0 parts |
| Fine particle-attached toner base particle | 104.0 parts |
| Methyltrimethoxysilane | 5.0 parts |

The pH of fine particle dispersion 46 was adjusted to 5.5, and heated at 50° C. for 3 hours using a water bath. The sample was dried under reduced pressure after being filtered by suction, thereby obtaining toner particle 46.

For toner particles 31 to 46 obtained as described above, the evaluations of <embedding rate of fine particles>, <dispersibility of fine particles>, and <release rate of fine particles> were performed. The evaluation results are shown in Table 8.

TABLE 8

| | | Embedding rate of fine particle (%) | | Dispersibility of fine particle (%) | | Release rate of fine particle (%) | |
|---|---|---|---|---|---|---|---|
| Example 31 | Toner particle 31 | A | 72 | A | 94 | A | 5 |
| Example 32 | Toner particle 32 | A | 68 | A | 95 | A | 6 |
| Example 33 | Toner particle 33 | A | 62 | A | 93 | A | 4 |
| Example 34 | Toner particle 34 | A | 68 | A | 96 | A | 6 |
| Example 35 | Toner particle 35 | A | 65 | A | 92 | A | 7 |
| Example 36 | Toner particle 36 | A | 66 | A | 98 | A | 4 |
| Example 37 | Toner particle 37 | B | 47 | A | 89 | A | 6 |
| Example 38 | Toner particle 38 | B | 46 | A | 87 | A | 9 |
| Example 39 | Toner particle 39 | B | 43 | B | 75 | B | 18 |
| Example 40 | Toner particle 40 | A | 68 | C | 48 | A | 7 |
| Example 41 | Toner particle 41 | A | 65 | B | 53 | A | 6 |
| Example 42 | Toner particle 42 | A | 72 | A | 89 | A | 5 |
| Example 43 | Toner particle 43 | A | 58 | A | 93 | B | 17 |
| Comp. Ex. 11 | Toner particle 44 | C | 13 | D | 14 | D | 62 |
| Comp. Ex. 12 | Toner particle 45 | Convex portion was not confirmed | | Convex portion was not confirmed | | Convex portion was not confirmed | |
| Comp. Ex. 13 | Toner particle 46 | C | 19 | B | 68 | D | 57 |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions This application claims the benefit of Japanese Patent Application No. 2017-096355, filed May 15, 2017, which is hereby incorporated by reference herein in its entirety.

What is claimed is:

1. A method of manufacturing a toner including a toner particle containing a binder resin, the method comprising processes (1) and (2):

process (1): preparing an aqueous mixed solution comprising a silicon compound represented by Formula (1), a fine particle having a number average particle diameter of 3 to 500 nm, and a toner base particle containing the binder resin, wherein the fine particle has an absolute value of zeta potential of 10.0 mV or more at the pH of the mixed solution $$(R^a)_n—Si—(R^b)_{4-n} \quad (1)$$

where $R^a$ independently represents a halogen atom, a hydroxyl group, or an alkoxy group; $R^b$ independently represents an alkyl group, an alkenyl group, an acyl group, an aryl group, an acryloxyalkyl group or a methacryloxyalkyl group; and n is an integer of 1 to 4; and process (2): adjusting a pH of the mixed solution to 7.0 to 12.0 to condense the silicon compound, wherein the pH is adjusted when the mixed solution is at a temperature of (Tg+10)° C. to 105° C., where Tg is a glass transition temperature of the toner base particle or the toner particle.

2. The method of manufacturing a toner according to claim 1, wherein after preparing the mixed solution in process (1), the pH of the mixed solution is maintained at pH (A), in process (2), the pH of the mixed solution is set at pH (B), $$3.0 \leq pH(A) \leq 8.0,$$

$$8.0 \leq pH(B) \leq 12.0, \text{ and}$$

$$pH(B) - pH(A) \geq 1.0.$$

3. The method of manufacturing a toner according to claim 1, wherein the fine particle is an inorganic fine particle.

4. The method of manufacturing a toner according to claim 1, wherein the content of the fine particle is 0.1 to 10.0 parts by mass, based on 100 parts by mass of the toner base particle.

5. The method of manufacturing a toner according to claim 1, wherein a surface of the fine particle is coated with a condensate of the silicon compound.

* * * * *